US006827421B2

(12) United States Patent
Nunokawa et al.

(10) Patent No.: US 6,827,421 B2
(45) Date of Patent: Dec. 7, 2004

(54) CARRYING DEVICE, PRINTING APPARATUS, CARRYING METHOD, AND PRINTING METHOD

(75) Inventors: Hirokazu Nunokawa, Nagano-ken (JP); Riki Kajiwara, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/434,478

(22) Filed: May 9, 2003

(65) Prior Publication Data

US 2004/0109037 A1 Jun. 10, 2004

(30) Foreign Application Priority Data

May 9, 2002 (JP) ..... 2002-133508
Jun. 11, 2002 (JP) ..... 2002-169946
Sep. 27, 2002 (JP) ..... 2002-284285

(51) Int. Cl.[7] ..... B41J 29/393

(52) U.S. Cl. ..... 347/19; 347/4; 347/104; 101/484; 400/582; 271/266; 271/270

(58) Field of Search ..... 347/4, 16, 19, 347/37, 104; 101/483, 484; 400/582, 583, 583.1, 583.2, 583.4; 271/266, 270; 399/395

(56) References Cited

U.S. PATENT DOCUMENTS 5,197,726 A * 3/1993 Nogami ..... 271/110
5,940,105 A * 8/1999 Hayami ..... 347/104
6,112,655 A * 9/2000 Suzuki et al. ..... 101/118
6,428,224 B1 * 8/2002 Askren et al. ..... 400/582
6,454,474 B1 * 9/2002 Lesniak et al. ..... 400/582
6,599,043 B2 * 7/2003 Kobayashi et al. ..... 400/582
6,650,077 B1 * 11/2003 Marra et al. ..... 318/560

FOREIGN PATENT DOCUMENTS

| | | | |
|---|---|---|---|
| EP | 8-72341 | A | 3/1996 |
| JP | 62-119075 | A | 5/1987 |
| JP | 3-262663 | A | 11/1991 |
| JP | 7-314838 | A | 12/1995 |
| JP | 2769016 | B2 | 4/1998 |
| JP | 11-49399 | A | 2/1999 |
| JP | 2001-88377 | A | 4/2001 |

* cited by examiner

*Primary Examiner*—Eugene H. Eickholt
(74) *Attorney, Agent, or Firm*—Sughrue Mion, PLLC

(57) ABSTRACT

A carrying device of the present invention is provided with a carrying mechanism for carrying a medium according to a target carry amount. Here, the carrying device: stores first correction information for correcting the target carry amount according to the target carry amount; receives information on the target carry amount from an outside section; corrects the target carry amount based on the first correction information and second correction information that is stored in the outside section and that is for correcting the target carry amount according to the target carry amount; and carries the medium with the carrying mechanism based on a corrected target carry amount.

39 Claims, 29 Drawing Sheets when a correction amount −C is added only once every two carries (occurrence of banding is reduced)

where
$\delta = 0.5C$ reference carry amount A= 7·D × (4/3)

| | target carry amount F (×D) | F+Fo (×D) | quotient m | excess carry amount remainder a (×D) | correction amount (×C) |
|---|---|---|---|---|---|
| pass 1~2 | 7 | 7.00 | 0 | 7.00 | 0 |
| pass 2~3 | 7 | 14.00 | 1 | 4.67 | 1 |
| pass 3~4 | 7 | 11.67 | 1 | 2.33 | 1 |
| pass 4~5 | 7 | 9.33 | 1 | 0.00 | 1 |
| pass 5~6 | 7 | 7.00 | 0 | 7.00 | 0 |
| pass 6~7 | 7 | 14.00 | 1 | 4.67 | 1 |
| pass 7~8 | 7 | 11.67 | 1 | 2.33 | 1 |
| pass 8~9 | 7 | 9.33 | 1 | 0.00 | 1 |

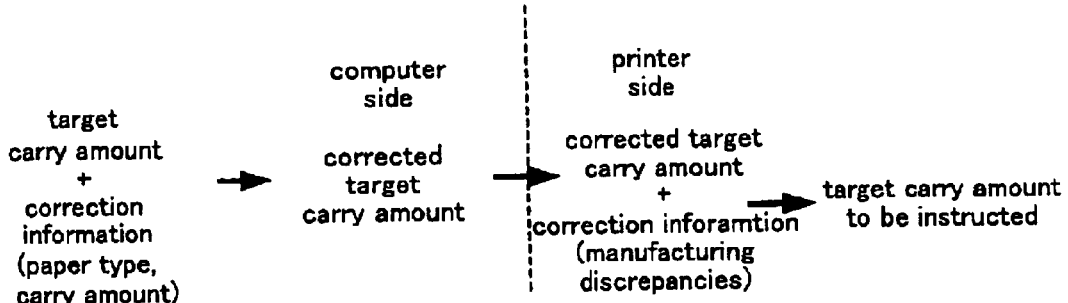
FIG. 19A
| | target carry amount | target carry amount in print data | target carry amount upon instruction |
|---|---|---|---|
| pass 1 | 7D | 7D | 7D |
| pass 2 | 7D | 7D | 7D−C |
| pass 3 | 7D | 7D | 7D |
| pass 4 | 7D | 7D−C | 7D−2C |
FIG. 19B
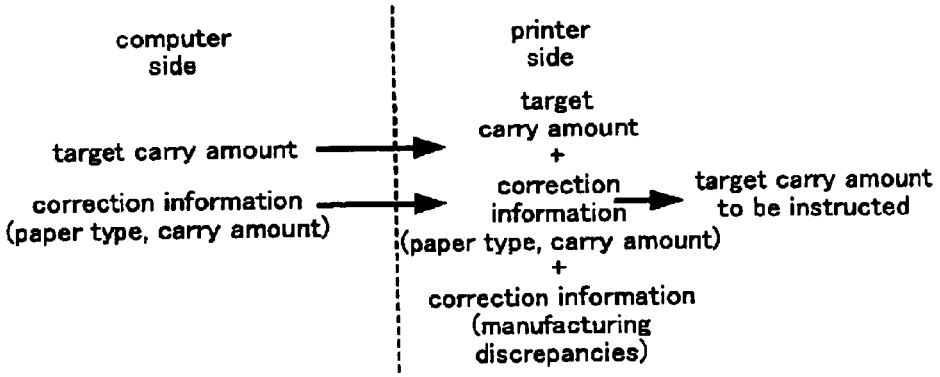
FIG. 20A
| | target carry amount | target carry amount in print data | target carry amount upon instruction |
|---|---|---|---|
| pass 1 | 7D | 7D | 7D |
| pass 2 | 7D | 7D | 7D−C |
| pass 3 | 7D | 7D | 7D−C |
| pass 4 | 7D | 7D | 7D−C |
FIG. 20B reference carry amount A =179D×(4/6)

| | target carry amount F (×D) | F+Fc (×D) | quotient m | excess carry amount remainder a(×D) | correction amount (×C) |
|---|---|---|---|---|---|
| pass 1~2 | 179 | 179.00 | 1 | 59.67 | 1 |
| pass 2~3 | 179 | 238.67 | 2 | 0.00 | 2 |
| pass 3~4 | 179 | 179.00 | 1 | 59.67 | 1 |
| pass 4~5 | 179 | 238.67 | 2 | 0.00 | 2 |
| pass 5~6 | 179 | 179.00 | 1 | 59.67 | 1 |
| pass 6~7 | 179 | 238.67 | 2 | 0.00 | 2 |
| pass 7~8 | 179 | 179.00 | 1 | 59.67 | 1 |
| pass 8~9 | 179 | 238.67 | 2 | 0.00 | 2 |

FIG. 27

CARRYING DEVICE, PRINTING APPARATUS, CARRYING METHOD, AND PRINTING METHOD

BACKGROUND OF THE INVENTION

The present application claims priority on Japanese Patent Application No. 2002-133508 filed on May 9, 2002, Japanese Patent Application No. 2002-169946 filed on Jun. 11, 2002, and Japanese Patent Application No. 2002-284285 filed on Sep. 27, 2002, which are herein incorporated by reference.

1. Field of the Invention

The present invention relates to a carrying device for carrying a medium (medium to be printed) such as paper. The present invention also relates to a printing apparatus, a carrying method, and a printing method.

2. Description of the Related Art

Inkjet printers that perform printing by intermittently ejecting ink are known as printing apparatuses for printing images onto various types of printing media, including paper, cloth, and film. With such inkjet printers, printing is carried out by alternately repeating the step of moving the medium to be printed in the paper-carrying direction and setting its position and the step of ejecting ink while shifting the nozzles in the shifting direction (also called the scanning direction).

With printers that intermittently carry the medium to be printed and perform printing between these intermittent carries, the carrying of the medium to be printed can affect whether the image quality is good or bad.

SUMMARY OF THE INVENTION

It is an object of the present invention to increase the precision with which media such as printing media are carried.

A first main aspect of the present invention for achieving the above object is a carrying device comprising:

a carrying mechanism for carrying a medium according to a target carry amount;

wherein the carrying device:

stores first correction information for correcting the target carry amount according to the target carry amount;

receives information on the target carry amount from an outside section;

corrects the target carry amount based on the first correction information and second correction information that is stored in the outside section and that is for correcting the target carry amount according to the target carry amount; and carries the medium with the carrying mechanism based on a corrected target carry amount.

A second main aspect of the present invention for achieving the above object is a carrying device comprising:

a carrying mechanism for intermittently carrying a medium according to a target carry amount;

wherein the carrying device:

determines a correction amount for the target carry amount for when performing an intermittent carry based on information on a carry amount at which carrying has been performed by the carrying mechanism before performing that carry.

A third primary aspect of the present invention for achieving the above object is a printing apparatus comprising:

a carrying mechanism for carrying a medium according to a target carry amount, and a carriage for moving a plurality of nozzles arranged at a nozzle pitch k·D;

wherein the printing apparatus performs:

when forming, on the medium, dots at a dot pitch D in a carrying direction by alternately repeating carrying of the medium in the carrying direction using the carrying mechanism and ejection of ink from the nozzles that are moved, carrying of the medium according to a target carry amount that has been corrected and carrying of the medium according to a target carry amount that has not been corrected, when performing k times of carries.

Features and objects of the present invention other than the above will become clear by reading the description of the present specification with reference to the appended drawings.

BRIEF DESCRIPTION OF THE DRAWINGS

FIG. 19A is an explanatory diagram of a comparative example. FIG. 19B is an explanatory diagram of how correction is carried out in the comparative example.

FIG. 20A is an explanatory diagram of the present embodiment. FIG. 20B is an explanatory diagram showing how correction is performed in the present embodiment.

FIG. 27 is an explanatory diagram showing the correction timing and the relationship between the correction amount and the reference correction amount A, in the same manner as in FIG. 17, in a case where six units of a minimum correction amount C are corrected in every four carries.

Figure 1:
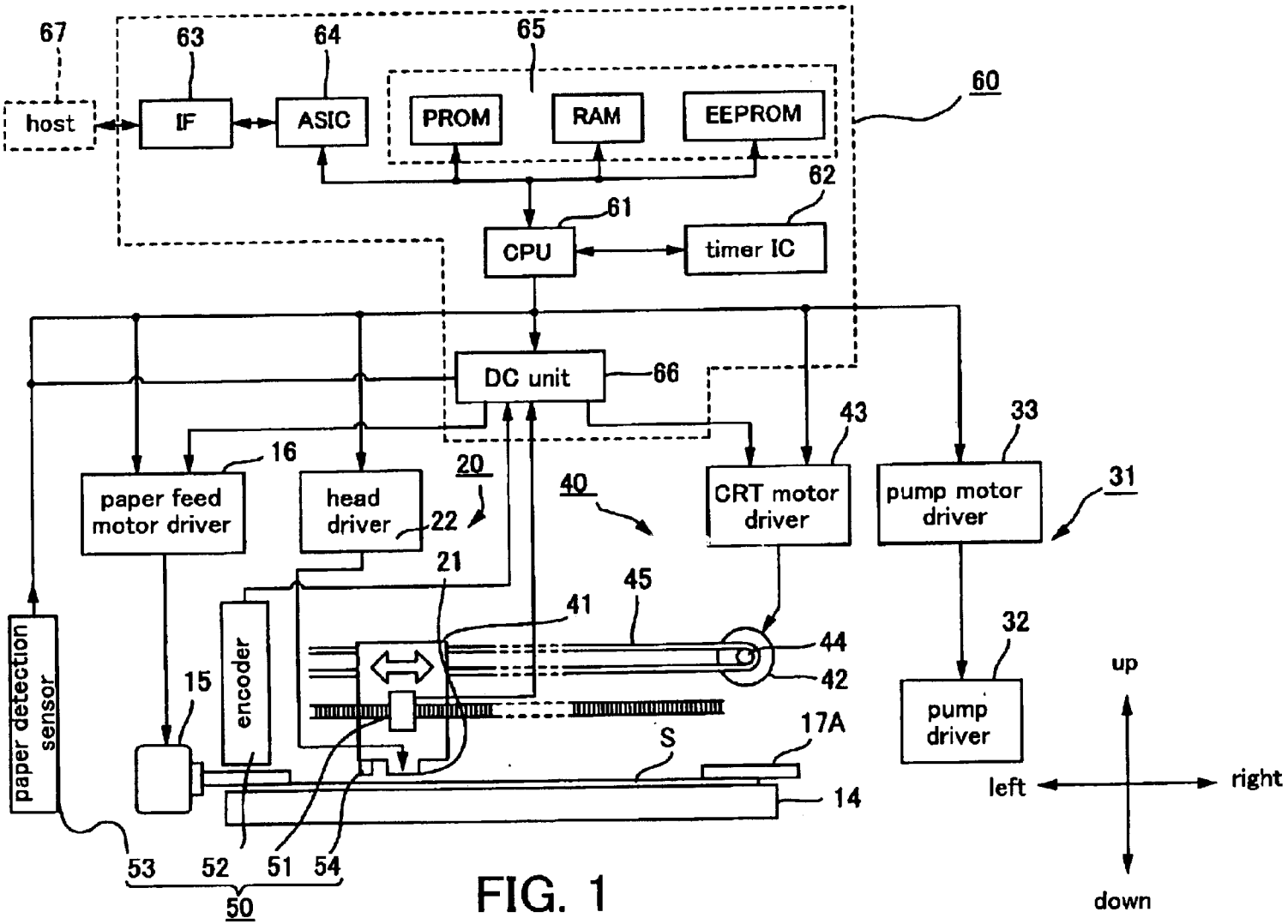
FIG. 1 is an explanatory diagram of the overall configuration of an inkjet printer according to the present embodiment.

For more complete understanding of the present invention and the advantages thereof, reference is now made to the following description taken in conjunction with the accompanying drawings.

DETAILED DESCRIPTION OF PREFERRED EMBODIMENTS

At least the following matters will be made clear by the explanation in the present specification and the description of the accompanying drawings.

A carrying device comprises:

a carrying mechanism for carrying a medium according to a target carry amount;

wherein the carrying device:

stores first correction information for correcting the target carry amount according to the target carry amount;

receives information on the target carry amount from an outside section;

corrects the target carry amount based on the first correction information and second correction information that is stored in the outside section and that is for correcting the target carry amount according to the target carry amount; and carries the medium with the carrying mechanism based on a corrected target carry amount.

With this carrying device it is possible to improve the precision at which the medium is carried.

In the carrying device, it is preferable that the first correction information is information on a carry error that occurs due to a discrepancy unique to the carrying device. According to this carrying device, the carrying device can be given information for canceling out carry error due to the device itself.

In the carrying device, it is preferable that the carrying mechanism intermittently carries the medium and that the first correction information is information on a ratio of correction to a number of times of carries performed by the carrying mechanism.

In the carrying device, it is preferable that the second correction information is information corresponding to a type of the medium. It is also preferable that the second correction information is information corresponding to the ease with which the medium will slip. In the carrying device, it is preferable that the second correction information is information corresponding to a carry mode of the carrying mechanism. It is also preferable that the second correction information is information for correcting the target carry amount the more the larger the target carry amount is. With these carrying devices, an outside section can be given information for canceling out carry errors whose causes can be ascertained with the outside section.

In the carrying device, it is preferable that the carrying mechanism is for carrying the medium intermittently, and that the second correction information is information on a ratio of correction to a number of times of carries performed by the carrying mechanism.

In the carrying device, it is preferable that the carrying mechanism is for carrying the medium intermittently, and that when the carrying mechanism intermittently carries the medium, there are instances in which the carrying device corrects the target carry amount and instances in which it does not correct the target carry amount. In the carrying device, it is also preferable that the carrying device sets a reference carry amount that serves as a reference based on the first correction information and the second correction information, and that it performs correction of the target carry amount each time the carrying mechanism carries the medium in excess of the reference carry amount. With these carrying devices, the carry error that has accumulated can be reduced even if the carry error that occurs per carry is equal to or less than the minimum unit.

In the carrying device, it is preferable that the carrying device is further provided with a detector for detecting a carry amount of the medium carried by the carrying mechanism, and that the carrying device corrects the target carry amount using a carry amount that is detectable by the detector as a minimum unit of correction.

Such printing apparatuses, carrying methods, storage media storing programs, and printing systems, for example, are also disclosed.

A carrying device comprises a carrying mechanism for intermittently carrying a medium according to a target carry amount;

wherein the carrying device:

determines a correction amount for the target carry amount for when performing an intermittent carry based on information on a carry amount at which carrying has been performed by the carrying mechanism before performing that carry.

With this carrying device, the target carry amount can be corrected in a manner that reflects the carry status or the correction status before performing that carrying.

In the carrying device, it is preferable that information on the carry amount includes information on an accumulated carry amount, which is obtained by accumulating the carry amount for which the medium has been carried by the carrying mechanism. With this printing apparatus, the correction amount can be determined based on the accumulation of the carry amount at which carrying is performed by the carrying mechanism before performing a carry. Thus, the correction amount can be corrected in a manner that reflects the carry status or the correction status before a carry is performed.

In the carrying device, it is preferable that the correction amount is determined based on the accumulated carry amount before performing a carry and a carry amount in which the target carry amount has been added to the accumulated carry amount. With this carrying device, the correction amount when performing a carry can be determined based on the accumulated carry amount before and after carrying.

In the carrying device, it is preferable that the correction amount is determined in accordance with a quotient of the accumulated carry amount divided by a reference carry amount serving as a reference. With this carrying device, if the accumulated carry amount is divided by the reference carry amount, then the accumulation of the correction amount can be found using that quotient, and thus the correction amount when carrying can be determined.

In the carrying device, it is preferable that the reference carry amount is set based on information on the medium. With this carrying device, it is possible to carry out correction that is in accordance with the medium because the reference carry amount is set in accordance with the medium.

In the carrying device, it is preferable that the reference carry amount is set based on a ratio of correction to the carry amount at which carrying is performed by the carrying mechanism. With this carrying device, it is possible to perform correction based on the carry amount because the reference carry amount is set in accordance with the ratio of correction with respect to the carry amount.

In the carrying device, it is preferable that the reference carry amount is set based on a print mode. With this carrying device, correction can be performed in accordance with the print mode because the reference carry amount is set to correspond to the print mode.

In the carrying device, it is preferable that information on the carry amount includes information on an excess carry amount at which carrying in excess of a predetermined carry amount has been performed by the carrying mechanism. With this carrying device, the correction amount can be determined based on the excess carry amount. Thus, the correction amount can be determined in a manner that reflects the carry status or the correction status before carrying is performed.

In the carrying device, it is preferable that the correction amount is determined based on a value obtained by adding the excess carry amount to the target carry amount. With this carrying device, the correction amount can be determined in a manner that reflects the carry status or the correction status before and after carrying is performed.

In the carrying device, it is preferable that the predetermined carry amount is an integer multiple of a reference carry amount serving as a reference. With this carrying device, the target carry amount is corrected each time the medium to be printed is carried in excess of the reference carry amount by the carrying mechanism.

In the carrying device, it is preferable that correction of the target carry amount is performed each time a carry at the reference carry amount is performed. With this carrying device, the correction of the target carry amount is distributed evenly.

In the carrying device, it is preferable that the reference carry amount is set based on information on the medium. With this carrying device, correction that corresponds to the medium can be performed because the reference carry amount is set according to the medium.

In the carrying device, it is preferable that the reference carry amount is set based on a ratio of correction to the carry amount at which carrying is performed by the carrying mechanism. With this carrying device, correction can be performed based on the carry amount because the reference carry amount is set to correspond to the ratio of correction to the carry amount.

In the carrying device, it is preferable that the reference carry amount is set based on a print mode. With this carrying device, correction according to the print mode can be carried out because the reference carry amount is set in accordance with the print mode.

It is preferable that the carrying device further includes a detector for detecting a carry amount of the medium carried by the carrying mechanism, and that the correction amount is an integer multiple of a minimum carry amount detectable by the detector. With this carrying device, the target carry amount can be corrected in accordance with the resolution of the detector.

A printing apparatus includes:

a carrying mechanism for intermittently carrying a medium to be printed according to a target carry amount;

wherein, the carrying device determines a correction amount for the target carry amount for when performing an intermittent carry based on information on a carry amount at which carrying has been performed by the carrying mechanism before performing that carry.

According to this printing apparatus, the target carry amount can be corrected in a manner that reflects the carry status or the correction status before a carry is performed.

A carrying method, includes:

correcting a target carry amount;

carrying a medium in accordance with a target carry amount that has been corrected; and performing an intermittent carry of the medium;

wherein the correction amount for the target carry amount when performing the intermittent carry is determined based on information on the carry amount at which carrying has been performed before performing that carry.

With this carrying method, the target carry amount can be corrected in a manner that reflects the carry status or the correction status before the carry is performed.

A storage medium storing a program, includes:

a memory for storing the program;

wherein the program:

makes a printing apparatus that has a carrying mechanism for intermittently carrying a medium according to a target carry amount determine a correction amount for the target carry amount for when performing an intermittent carry based on information on a carry that has been performed by the carrying mechanism before performing that carry.

With a storage medium storing this program, it is possible to control the printing apparatus so that the target carry amount is corrected in a manner that reflects the carry status or the correction status before the carry is performed.

A printing system for carrying out printing of a medium to be printed, including:

a computer, and a carrying mechanism for intermittently carrying the medium to be printed according to a target carry amount;

wherein, a correction amount for the target carry amount for when performing an intermittent carry is determined based on information on a carry amount at which carrying has been performed by the carrying mechanism before performing that carry.

With this printing system, the printing apparatus can correct the target carry amount in a manner that reflects the carry status or the correction status before carrying is performed.

A printing apparatus, includes:

a carrying mechanism for carrying a medium according to a target carry amount, and a carriage for moving a plurality of nozzles arranged at a nozzle pitch k·D;

wherein the printing apparatus performs:

when forming dots at a dot pitch D on the medium in a carrying direction by alternately repeating carrying of the medium in the carrying direction using the carrying mechanism and ejecting of ink from the nozzles that are moved, carrying of the medium according to a target carry amount that has been corrected and carrying of the medium according to a target carry amount that has not been corrected, when performing k times of carries.

With this printing apparatus, the precision at which the medium is carried can be increased, and thus the picture quality can be improved.

In the printing apparatus, it is preferable that a raster line formed after a certain carry operation is adjacent to a raster line formed (k−1) carry operations after forming the certain raster line. With this printing apparatus, banding can be kept from occurring, and thus the picture quality can be improved.

In the printing apparatus, it is preferable that whether or not correction of the target carry amount is necessary is determined based on an error of a carry amount of a medium that is carried by the carrying mechanism. With this printing apparatus, the error of the carry amount can be inhibited, and thus extreme closeness or distance in the dot pitch can be inhibited.

In the printing apparatus, it is preferable that whether or not correction of the carry amount is necessary is determined based on an error of a carry amount that has accumulated due to the intermittent carrying. With this printing apparatus, the precision at which the medium is carried can be increased, and thus the picture quality can be improved, even if the error that occurs due to a single carry is smaller than the minimum correction amount with which correction can be made by the carrying mechanism.

In the printing apparatus, it is preferable that the carry amount is corrected when the error that has accumulated is larger than a carry amount that can be corrected by the carrying mechanism. With this printing apparatus, the precision at which the medium to be printed is carried can be increased, and thus the picture quality can be improved, even if the error that occurs due to a single carry is smaller than the minimum correction amount with which correction can be made by the carrying mechanism.

In the printing apparatus, it is preferable that the error of the carry amount is found before an error actually occurs. With this printing apparatus, an error can be inhibited before the error actually occurs.

In the printing apparatus, it is preferable that whether or not correction of the target carry amount is necessary is determined based on a carry amount of the medium. With this printing apparatus, whether or not correction is necessary can be determined based on the carry amount, which is easily detected.

In the printing apparatus, it is preferable that whether or not correction of the target carry amount is necessary is determined based on a total carry amount of the intermittent carrying. With this printing apparatus, whether or not correction is necessary can be determined based on the total carry amount, which is easily detected.

In the printing apparatus, it is preferable that whether or not correction of the target carry amount is necessary is determined based on the number of times of the intermittent carrying. With this printing apparatus, whether or not correction is necessary can be determined based on the number of times of carrying, which is easily detected.

A printing method comprises:

forming dots on a medium at a dot pitch D in a carrying direction by repeating in alternation a step of carrying said medium according to a target carry amount, and a step of moving a plurality of nozzles arranged at a nozzle pitch k·D and ejecting ink from said nozzles that are moved; wherein when k times of carries are performed, carrying of said medium according to a target carry amount that has been corrected and carrying of said medium according to a target carry amount that has not been corrected are performed.

With this printing method, the precision at which the medium is carried is increased, allowing the picture quality to be improved.

A storage medium storing a program, including:

a memory for storing the program;

wherein the program makes a printing apparatus provided with a carrying mechanism for carrying a medium according to a target carry amount and a carriage for moving a plurality of nozzles arranged at a nozzle pitch k·D perform carrying of the medium according to a target carry amount that has been corrected and carrying of the medium according to a target carry amount that has not been corrected, when performing k times of carries, when the printing apparatus is made to form dots on the medium at a dot pitch D in a carrying direction by alternately repeating carrying of the medium in the carrying direction using the carrying mechanism and ejecting of ink from the nozzles that are moved.

With this storage medium, the precision at which the medium is carried in increased, allowing the picture quality to be improved.

A printing system is provided with:

a computer, a carrying mechanism for carrying a medium according to a target carry amount, and a carriage for moving a plurality of nozzles arranged at a nozzle pitch k·D;

wherein the printing system, when forming dots on the medium at a dot pitch D in a carrying direction by alternately repeating carrying of the medium in the carrying direction using the carrying mechanism and ejecting of ink from the nozzles that are moved, performs carrying of the medium according to a target carry amount that has been corrected and carrying of the medium according to a target carry amount that has not been corrected, when performing k times of carries.

With this printing system, the precision at which the medium is carried in increased, allowing the picture quality to be improved.

Overview of Printing Apparatus (Inkjet Printer)

<Configuration of Inkjet Printer>

Figure 2:
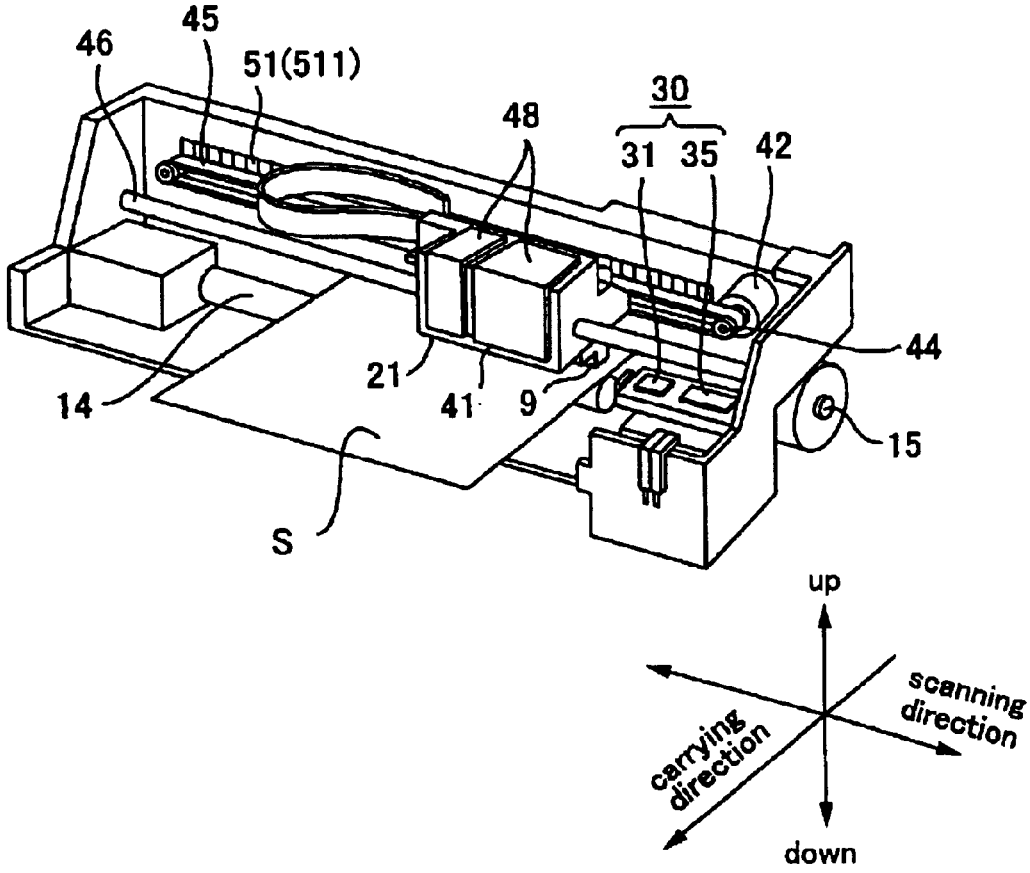
FIG. 2 is a schematic diagram of a carriage area of the inkjet printer according to the present embodiment.
Figure 3:
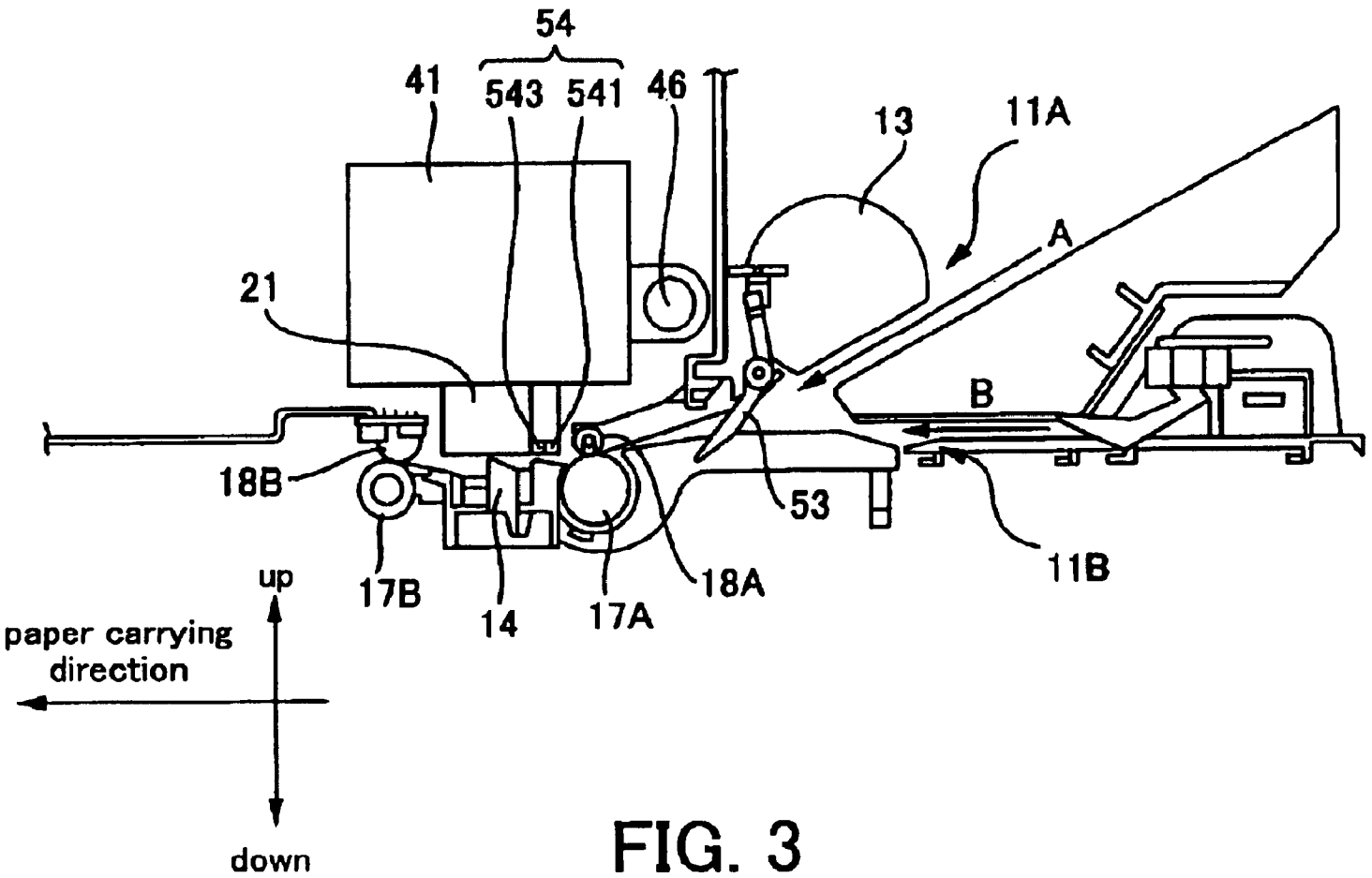
FIG. 3 is an explanatory diagram of an area around the carrying unit of the inkjet printer according to the present embodiment.
Figure 4:
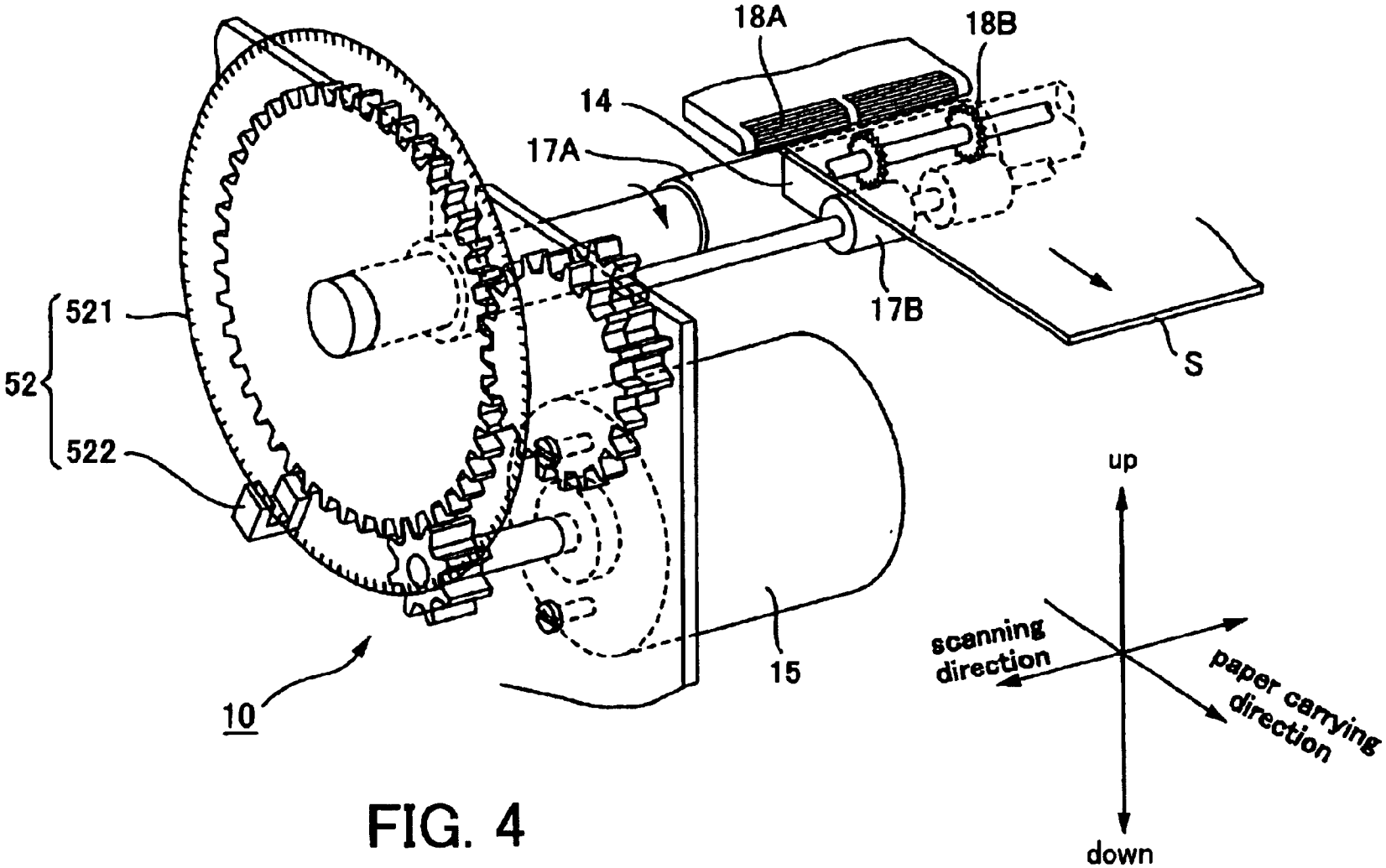
FIG. 4 is a perspective view of an area around the carrying unit of the inkjet printer according to the present embodiment.

An overview of an inkjet printer serving as an example of a printing apparatus is described with reference to FIG. 1, FIG. 2, FIG. 3, and FIG. 4. Note that FIG. 1 is an explanatory diagram of the overall configuration of an inkjet printer of this embodiment. FIG. 2 is a schematic diagram of an area around the carriage of the inkjet printer of this embodiment. FIG. 3 is an explanatory diagram of the area around the carrying unit of the inkjet printer of this embodiment. FIG. 4 is a perspective view of the area around the carrying unit of the inkjet printer of this embodiment. It should be noted that the printer itself and the carrying unit also function as carrying devices for carrying paper.

The inkjet printer of this embodiment has a paper carrying unit 10, an ink ejection unit 20, a cleaning unit 30, a carriage unit 40, a measuring instrument group 50, and a control unit 60.

The paper carrying unit 10 is for feeding paper, which is an example of a medium to be printed, to a printable position and making the paper move in a predetermined direction (in FIG. 1, the direction perpendicular to the paper face (hereinafter, this is referred to as the paper-carrying direction)) by a predetermined shift amount during printing. That is, the paper carrying unit 10 functions as a carrying mechanism (carrying means) for carrying paper. The paper carrying unit 10 has a paper insert opening 11A and a roll paper insert opening 11B, a paper supply motor (not shown), a paper supply roller 13, a platen 14, a paper feed motor (hereinafter, referred to as PF motor) 15, a paper feed motor driver (hereinafter, referred to as PF motor driver) 16, a paper feed roller 17A and paper discharge rollers 17B, and free rollers 18A and free rollers 18B. However, in order for the paper carrying unit 10 to function as a carrying mechanism it is not absolutely necessary that it have all of these structural elements.

The paper insert opening 11A is where paper, which is a medium to be printed, is inserted. The paper supply motor (not shown) is a motor for carrying the paper that has been inserted into the paper insert opening 11A into the printer, and is constituted by a pulse motor. The paper supply roller 13 is a roller for automatically carrying the paper that has been inserted into the paper insert opening 11A into the printer, and is driven by the paper supply motor 12. The paper supply roller 13 has a transverse cross-sectional shape that is substantially the shape of the letter D. The periphery length of a circumference section of the paper supply roller 13 is set longer than the carrying distance to the PF motor 15, so that using this circumference section the medium to be printed can be carried up to the PF motor 15. It should be noted that a plurality of printing media are prevented from being supplied at one time through the rotational drive force of the paper supply roller 13 and the friction resistance of separating pads (not shown). The sequence through which the medium to be printed is carried is described in detail later.

The platen 14 supports the paper S during printing. The PF motor 15 is a motor for feeding paper, which is an example of a medium to be printed, in the paper carrying direction, and is constituted by a DC motor. The PF motor driver 16 is for driving the PF motor 15. The paper feed roller 17A is a roller for feeding the paper S that has been carried into the printer by the paper supply roller 13 to a printable region, and is driven by the PF motor 15. The free rollers 18A are provided in a position that is in opposition to the paper feed roller 17A, and push the paper S toward the paper feed roller 17A by sandwiching the paper S between them and the paper feed roller 17A.

The paper discharge rollers 17B are rollers for discharging from the printer the paper S for which printing has finished, and are driven by the PF motor 15 through a gear wheel that is not shown in the drawings. The free rollers 18B are provided in a position that is in opposition to the paper discharge rollers 17B, and push the paper S toward the paper discharge roller 17B by sandwiching the paper S between them and the paper discharge rollers 17B.

The ink ejection unit 20 is for ejecting ink onto paper, which is an example of the medium to be printed. The ink ejection unit 20 has a head 21 and a head driver 22. The head 21 has a plurality of nozzles, which are ink ejection sections, and ejects ink intermittently from each of the nozzles. The head driver 22 is for driving the head 21 so that ink is ejected intermittently from the head.

The cleaning unit 30 is for preventing the nozzles of the head 21 from becoming clogged. The cleaning head 30 has a pump device 31 and a capping device 35. The pump device is for extracting ink from the nozzles in order to prevent the nozzles of the head 21 from becoming clogged, and has a pump motor 32 and a pump motor driver 33. The pump motor 32 sucks out ink from the nozzles of the head 21. The pump motor driver 33 drives the pump motor 32. The capping device 35 is for sealing the nozzles of the head 21 when printing is not being performed (during standby) so that the nozzles of the head 21 are kept from becoming clogged.

The carriage unit 40 is for making the head 21 scan and move in a predetermined shifting direction (in FIG. 1, the left to right direction of the paper face (hereinafter, this is referred to as the scanning direction)). The carriage unit 40 has a carriage 41, a carriage motor (hereinafter, referred to as CR motor) 42, a carriage motor driver (hereinafter, referred to as CR motor driver) 43, a pulley 44, a timing belt 45, and a guide rail 46. The carriage 41 can be moved in the scanning direction, and the head 21 is fastened to it (therefore, the nozzles of the head 21 intermittently eject ink as they are moved in the scanning direction). The carriage 41 also removably holds an ink cartridge 48 that accommodates ink. The CR motor 42 is a motor for shifting the carriage in the scanning direction, and is constituted by a DC motor. The CR motor driver 43 is for driving the CR motor 42. The pulley 44 is attached to the rotation shaft of the CR motor 42. The timing belt 45 is driven by the pulley 44. The guide rail 46 is for guiding the carriage 41 in the scanning direction.

The measuring instrument group 50 includes a linear encoder 51, a rotary encoder 52, a paper detection sensor 53, and a paper width sensor 54. The linear encoder 51 is for detecting the position of the carriage 41. The rotary encoder 52 is for detecting the amount of rotation of the paper feed roller 17A. Note that the configuration etc. of the encoders is discussed later. The paper detection sensor 53 is for detecting the position of the front edge of the paper to be printed. The paper detection sensor 53 is provided in a position where it can detect the position of the front edge of the paper as the paper is being carried toward the paper feed roller 17A by the paper supply roller 13. It should be noted that the paper detection sensor 53 is a mechanical sensor that detects the front edge of the paper through a mechanical mechanism. More specifically, the paper detection sensor 53 has a lever that can be rotated in the paper carrying direction, and this lever is arranged so that it protrudes into the path over which the paper is carried. In this way, the front end of the paper comes into contact with the lever and the lever is rotated, and thus the paper detection sensor 53 detects the position of the front end of the paper by detecting the movement of the lever. The paper width sensor 54 is attached to the carriage 41. The paper width sensor 54 is an optical sensor having a light-emitting section 541 and a light-receiving section 543, and detects whether the paper exists or not in the position of the paper width sensor 54 by detecting light that is reflected by the paper. The paper width sensor 54 detects the position of the edge of the paper while being moved by the carriage 41, so as to detect the width of the paper. The paper width sensor 54 can detect the front edge of the paper by the position of the carriage 41. The paper width sensor 54 is an optical sensor, and thus detects positions with higher precision than the paper detection sensor 53.

The control unit 60 is for carrying out the controls of the printer. The control unit 60 has a CPU 61, a timer 62, an interface section 63, an ASIC 64, a memory 65, and a DC controller 66. The CPU 61 is for carrying out the overall control of the printer, and sends control commands to the DC controller 66, the PF motor driver 16, the CR motor driver 43, the pump motor driver 32, and the head driver 22. The timer 62 periodically generates interrupt signals with respect to the CPU 61. The interface section 63 exchanges data with a host computer 67 provided outside the printer. The ASIC 64 controls the printing resolution and the drive waveforms of the head, for example, based on printing information sent from the host computer 67 through the interface section 63. The memory 65 is for reserving an area for storing the programs for the ASIC 64 and the CPU 61 and a working storage, for instance, and has storage means such as a PROM, a RAM, or an EEPROM. The DC controller 66 controls the PF motor driver 16 and the CR motor driver 43 based on control commands sent from the CPU 61 and the output from the measuring instrument group 50.

<Configuration of the Encoders>

Figure 5:
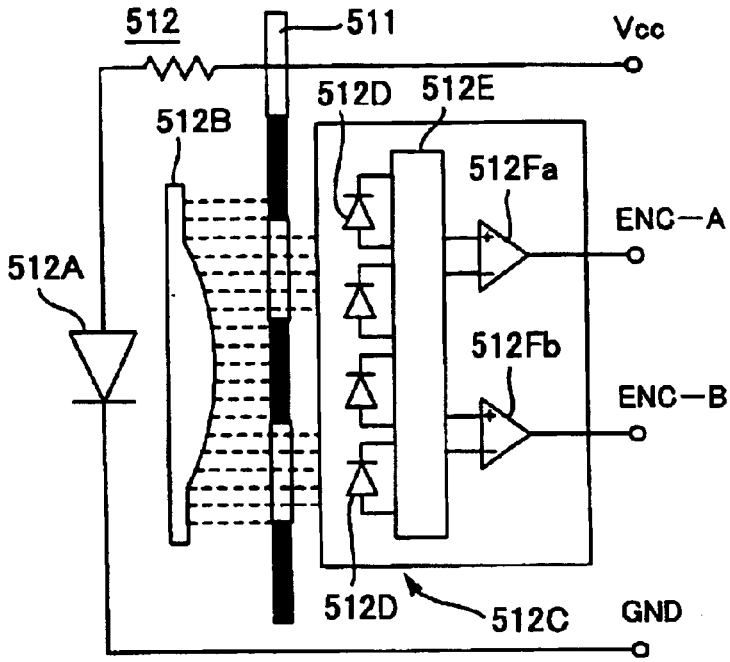
FIG. 5 is an explanatory diagram of the configuration of a linear encoder.

FIG. 5 is an explanatory diagram of the linear encoder 51.

The linear encoder 51 is for detecting the position of the carriage 41, and has a linear scale 511 and a detection section 512.

The linear scale 511 is provided with slits at a predetermined spacing (for example, every 1/180 inch (1 inch equals 2.54 cm)), and is fastened to the main printer unit.

The detection section 512 is provided in opposition to the linear scale 511, and is on the side of the carriage 41. The detection section 512 has a light-emitting diode 512A, a collimating lens 512B, and a detection processing section 512C. The detection processing section 512C is provided with a plurality (for instance, four) photodiodes 512D, a signal processing circuit 512E, and two comparators 512Fa and 512Fb.

The light-emitting diode 512A emits light when a voltage Vcc is applied to it via resistors on both sides, and this light is incident on the collimating lens. The collimating lens 512B turns the light that is emitted from the light-emitting diode 512A into parallel light, and the parallel light is irradiated on the linear scale 511. The parallel light that has passed through the slits provided in the linear scale then passes through stationary slits (not shown) and is incident on the photodiodes 512D. The photodiodes 512D convert the incident light into electrical signals. The electrical signals that are output from the photodiodes are compared in the comparators 512Fa and 512Fb, and the results of these comparisons are output as pulses. The pulse ENC-A and the pulse ENC-B that are output from the comparators 512Fa and 512Fb are the output of the linear encoder 51.

Figure 6A:
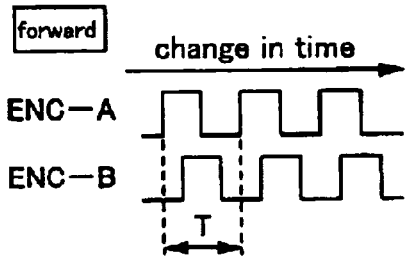
FIG. 6A and FIG. 6B are timing charts showing the waveforms of the output signals of the linear encoder.
Figure 6B:
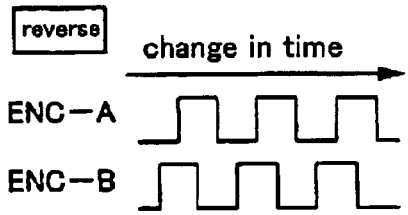

FIG. 6A is a timing chart of the waveform of the output signals of the linear encoder 51 when the CR motor 42 is rotating forward. FIG. 6B is a timing chart of the waveform of the output signals of the linear encoder 51 when the CR motor 42 is rotating in reverse.

As shown in FIG. 6A and FIG. 6B, the phases of the pulse ENC-A and the pulse ENC-B are misaligned by 90 degrees both when the CR motor 42 is rotating forward and when it is rotating in reverse. When the CR motor 42 is rotating forward, that is, when the carriage 41 is moving in the main-scanning direction, then, as shown in FIG. 6A, the phase of the pulse ENC-A leads the phase of the pulse ENC-B by 90 degrees. On the other hand, when the CR motor 42 is rotating in reverse, then, as shown in FIG. 6B, the phase of the pulse ENC-A is delayed by 90 degrees with respect to the phase of the pulse ENC-B. A single period T of the pulses is equivalent to the time during which the carriage 41 is shifted by the spacing of the slits of the linear scale 511 (for example, by 1/180 inch (1 inch equals 2.54 cm)).

The position of the carriage 41 is detected as follows. First, the rising edge or the falling edge of either the pulse ENC-A or ENC-B is detected, and the number of detected edges is counted. The position of the carriage 41 is calculated based on the counted number. With respect to the counted number, when the CR motor 42 is rotated forward, then for each detected edge a "+1" is added, and when the CR motor 42 is rotating in reverse, then for each detected edge a "−1" is added. Because the period of the pulses ENC is equal to the slit spacing of the linear scale 511, when the counted number is multiplied by the slit spacing, the amount that the carriage 41 has moved from when the count number is "0" can be obtained. In other words, the resolution of the linear encoder 51 in this case becomes the slit spacing of the linear scale 511. It is also possible to detect the position of the carriage 41 using both the pulse ENC-A and the pulse ENC-B. The periods of the pulse ENC-A and the pulse ENC-B are equal to the slit spacing of the linear scale 511, and the phases of the pulses ENC-A and ENC-B are misaligned by 90 degrees, so that if the rising edges and the falling edges of the pulses are detected and the number of detected edges is counted, then a counted number of "1" corresponds to ¼ of the slit spacing of the linear scale 511. Therefore, if the count number is multiplied by ¼ of the slit spacing, then the amount that the carriage 41 has moved from a count number of "0" can be obtained. That is, the resolution of the linear encoder 51 in this case is ¼ the slit spacing of the linear scale 511.

The velocity Vc of the carriage 41 is detected as follows. First, the rising edges or the falling edges of either the pulse ENC-A or ENC-B are detected. The time interval between edges of the pulses is counted with a timer counter. The period T (T=T1, T2, . . . ) is found from the value that is counted. Then, when the slit spacing of the linear scale 511 is regarded as λ, the velocity of the carriage can be sequentially found as λ/T. It is also possible to detect the velocity of the carriage 41 using both the pulse ENC-A and the pulse ENC-B. By detecting the rising edges and the falling edges of the pulses, the time interval between edges, which corresponds to ¼ of the slit spacing of the linear scale 511, is counted by a timer counter. The period T (T=T1, T2, . . . ) is found from the value that is counted. Then, when the slit spacing of the linear scale 511 is regarded as λ, the velocity Vc of the carriage can be found sequentially as Vc=λ/(4 T).

Note that the rotary encoder 52 has substantially the same configuration as the linear encoder 51, except that a rotation disk 521 that rotates in conjunction with rotation of the paper feed roller 17A is used in place of the linear scale 511 that is provided on the main printer unit, and that a detection section 522 provided on the main printer unit is used in place of the detection section 512 that is provided on the carriage 41 (see FIG. 4).

It should be noted that the rotary encoder 52 directly detects the rotation amount of the paper feed roller 17A. On the other hand, when the paper feed roller 17A is rotated to carry the paper, a carry error occurs due to slippage between the paper feed roller 17A and the paper. Consequently, the rotary encoder 52 is not directly detecting the carry amount of the paper. Accordingly, it is possible to create a table that expresses the relationship between the rotation amount detected by the rotary encoder 52 and the carry error, and then store this table in the memory 65 of the control unit 60. Then, based on the results detected by the rotary encoder, the table is referenced and the carry amount of the paper (or the carry error) is detected. This table is not limited to expressing the relationship between the rotation amount and the carry error, and may also express the relationship between the rotation amount and the carry amount or may express the relationship between the number of times of carries, for example, and the carry error. Also, because slippage differs depending on the characteristics of the paper, it is also possible to create a plurality of tables corresponding to the paper characteristics and to store these in the memory 65.

Also, the minimum carry amount (minimum unit C) that can be carried by the carrying unit is determined based on the resolution of the rotary encoder. It should be noted that in this embodiment, the minimum correctable carry amount is set to 1/5760 inch (the dot pitch is 1/720 inch).

<Configuration of the Nozzles>

Figure 7:
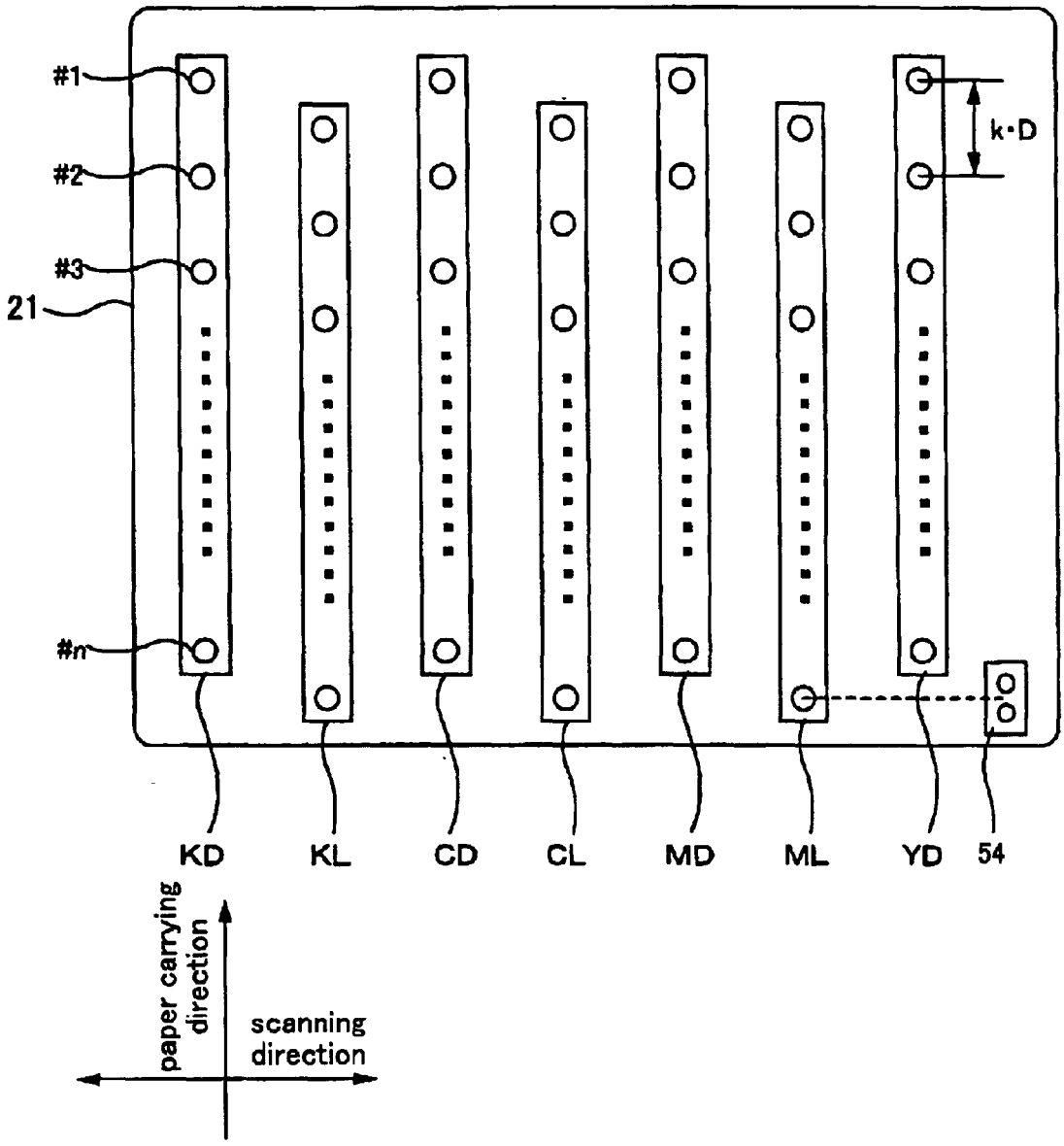
FIG. 7 is an explanatory diagram showing the arrangement of the nozzles in the lower surface of the head.

FIG. 7 is an explanatory diagram showing the arrangement of the nozzles in the lower surface of the head 21. In the lower surface of the head 21 there are formed a dark black ink nozzle group KD, a light black ink nozzle group KL, a dark cyan ink nozzle group CD, a light cyan ink nozzle group CL, a dark magenta ink nozzle group MD, a light magenta nozzle group ML, and a yellow ink nozzle group YD. Each nozzle group is provided with a plurality (in this embodiment, n) of nozzles, which are ejection openings for ejecting the various colors of ink. It should be noted that the first alphabet letter in the reference characters indicating the nozzle groups represents the ink color, whereas the accompanying letter "D" means that the ink is of relatively high concentration and the accompanying letter "L" means that the ink is of relatively low concentration.

The plurality of nozzles of the nozzle groups are arranged at a constant spacing (nozzle pitch: k·D) in the paper carrying direction. Here, D is the minimum dot pitch in the paper carrying direction (that is, the spacing at the highest resolution of the dots formed on the paper S), and for example, if the resolution is 720 dpi, then D is 1/720 inch (approximately 35.3 μm). Also, k is an integer of one or more.

The nozzles of the nozzle groups are assigned numbers that become smaller toward the downstream side (#1 to #n). Also, as regards their positions in the paper carrying direction, the nozzles of each nozzle group are provided so that they are positioned between the nozzles of adjacent nozzle groups. For example, the first nozzle #1 of the light black ink nozzle group KL is provided between the first nozzle #1 and the second nozzle #2 of the dark black ink nozzle group KD, as regards its position in the paper carrying direction. Also, the paper width sensor 54 is provided substantially in the same position as the nth nozzle #n furthest downstream, as regards its position in the paper carrying direction. Each nozzle is provided with a piezo element (not shown) as a drive element for driving the nozzle and making it eject ink droplets.

It should be noted that during printing the paper S is carried intermittently by the paper carrying unit 10 by a predetermined carry amount F, and between these intermittent carries the carriage 41 is moved in the main-scanning direction and ink droplets are ejected from the nozzles.

Relationship Between Paper Carry Amount and Drop in Picture Quality

REFERENCE EXAMPLE

<If There is no Carry Error>

Figure 8:
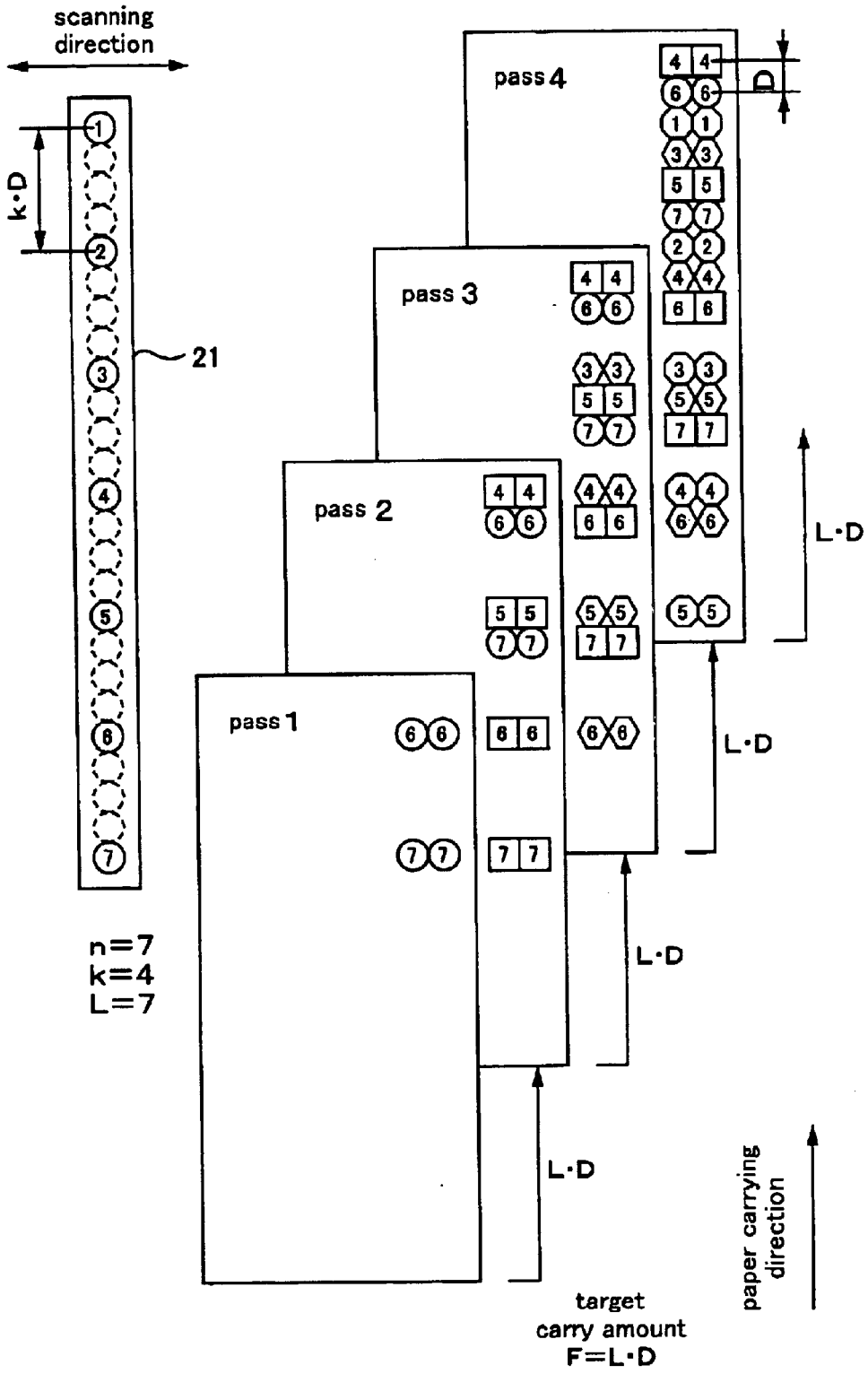
FIG. 8 is an explanatory diagram showing how dots are formed if there is no error when the paper S is carried (reference example).

FIG. 8 is an explanatory diagram showing how dots are formed if there is no carry error when the paper S is carried (that is, if the amount the paper S is carried by the carrying unit matches the target carry amount). In the diagram, for the sake of convenience, the head 21 is shown having only seven nozzles for a single color (that is, n=7). Also, in the diagram, for the sake of convenience the paper S is depicted as if moving also in the scanning direction; however, in practice, the paper S moves only in the paper carrying direction and does not move in the scanning direction.

In the figure, the nozzle pitch k·D of the nozzle group is four times the dot pitch D (that is, k=4). It should be noted that the numbers 1 to 7 shown within circles in the head 21 indicate the nozzle number. As shown in the figure, as the nozzles decrease in number they are provided more on the downstream side in the paper carrying direction.

The paper S is moved in steps by the carrying unit 10 in carry amounts of F=L·D (L is an integer and D is the dot pitch) in the paper scanning direction after the nozzles have been moved and scanned (hereinafter, referred to as a "pass") once in the scanning direction. In the figure, the carry amount F by which the carrying unit 10 carries is 7·D (that is, L=7), and the target carry amount is also 7·D. It should be noted that if the paper S is carried at a constant carry amount F (=L·D), then it is preferable that an integer L is adopted such that when it is divided by the integer k, the remainder is (k−1).

In the paper S, the circles represent the positions of the dots (position of the pixels) formed in the first pass, the squares represent the positions of the dots formed in the second pass, the hexagons represent the positions of the dots formed in the third pass, and the octagons represent the positions of the dots formed in the fourth pass. Also, the numbers within these symbols represent the number of the nozzle that ejected the ink for forming that dot. Also, in the figure, two dots are formed per pass; however, in practice, ink is ejected intermittently as the nozzles are moved in the scanning direction, and thus numerous dots are formed in a line (hereinafter, this is referred to as a "raster line") in the scanning direction.

With the recording technique of the figure, each time the paper S is carried in the scanning direction by the carry amount F, the nozzles record a raster line immediately above the raster line recorded in the prior pass. The recording technique of the figure is an example of "interlace printing." Here, interlace printing is used to mean a print method in which k is at least 2 and a raster line that is not recorded is sandwiched between the raster lines that are recorded in a single pass. Also, with interlace printing, L=n (n is the number of nozzles) and k and n are coprime.

<If There is Carry Error>

Figure 9:
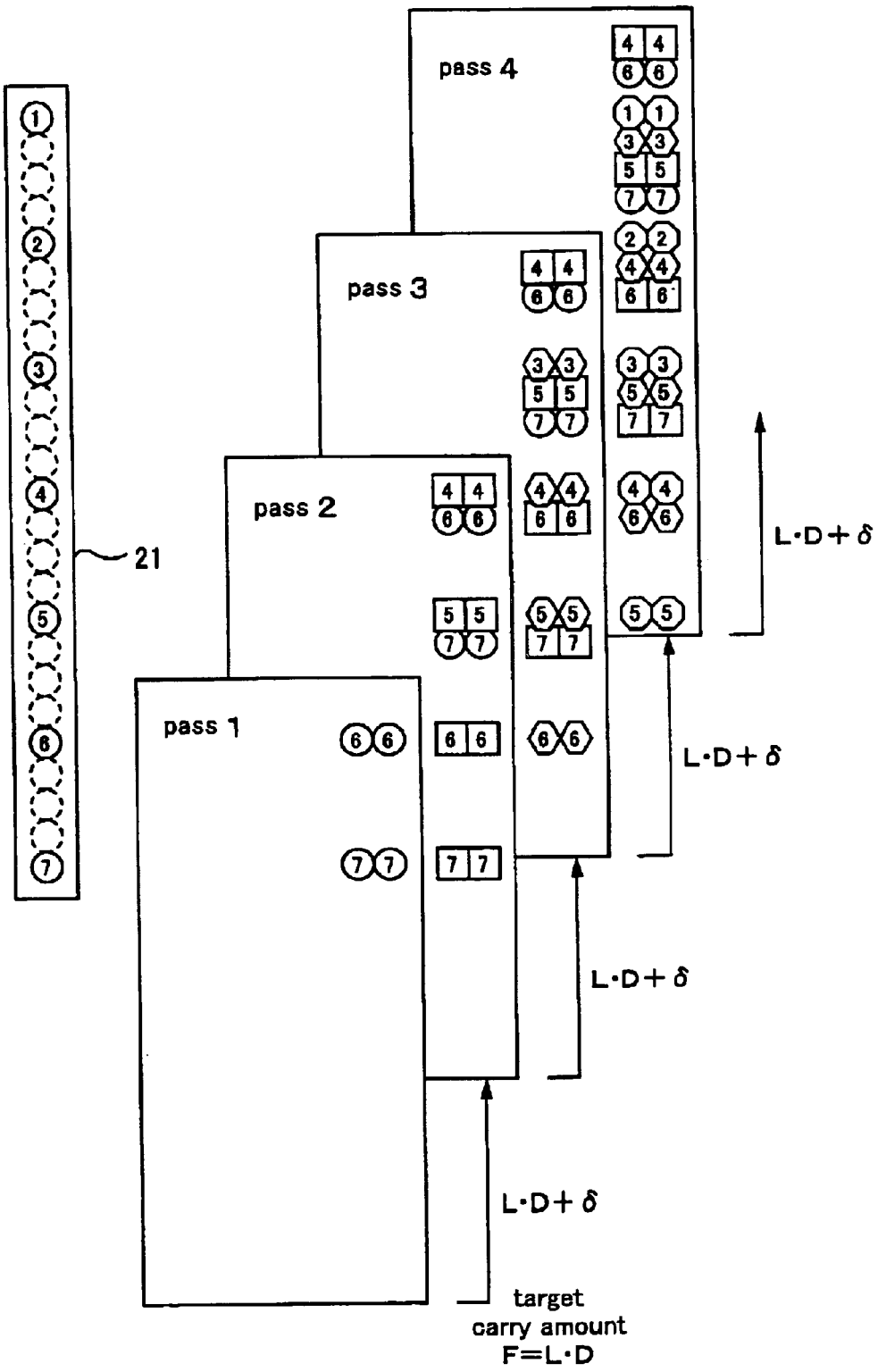
FIG. 9 is an explanatory diagram showing how dots are formed if there is error when the paper S is carried (reference example).
Figure 10:
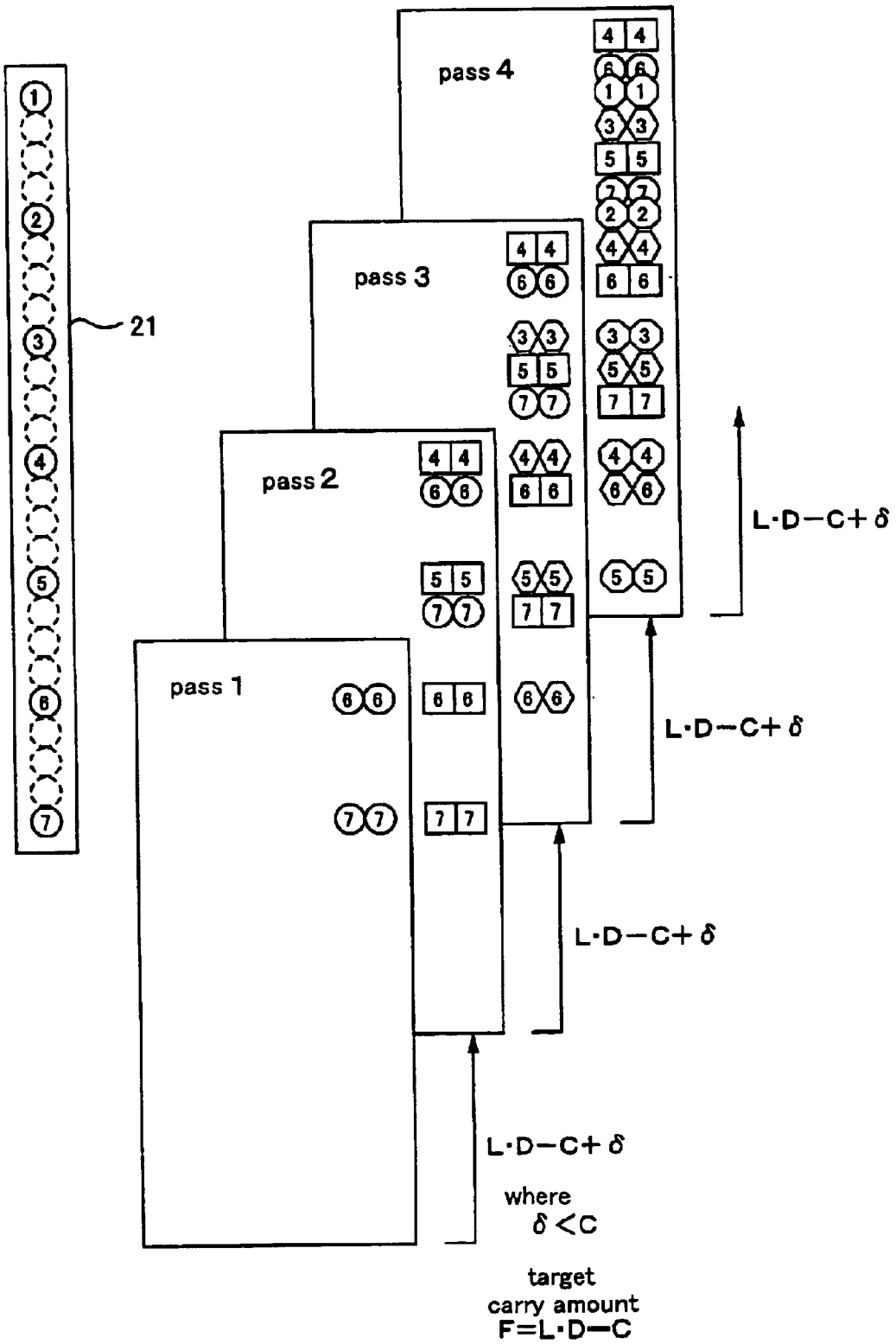
FIG. 10 is an explanatory diagram showing how dots are formed when, if there is error when the paper S is carried, the carry amount of the carrying unit is corrected every time (reference example).

FIG. 9 is an explanatory diagram showing how dots are formed if there is error when the paper S is carried (that is, if the amount carried by the carrying unit includes error with respect to the target carry amount). FIG. 10 is an explanatory diagram showing how dots are formed when, if there is error when the paper S is carried, the target carry amount of the carrying unit is corrected each time. FIG. 11 is an explanatory diagram showing how print bands (banding) occur in FIGS. 9 and 10.

Figure 11A:
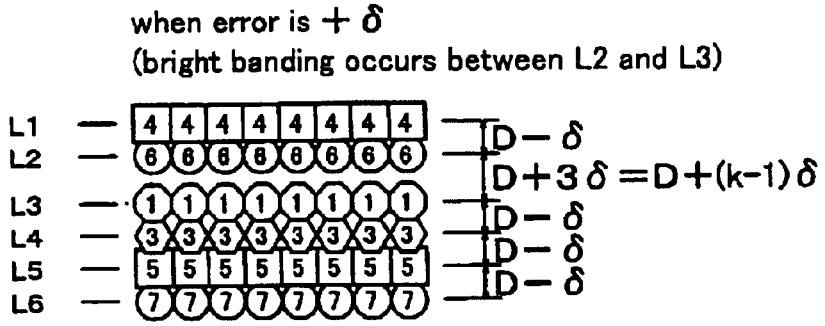
FIG. 11A is an explanatory diagram showing how print bands (banding) occur in FIG. 9 (reference example).

In FIG. 9, the carrying unit carries the paper by the carry amount (F+δ), which includes a constant positive error δ, when a command signal for the target carry amount F (=L·D) is input. That is, the paper S is carried downstream in the paper carrying direction by an amount that is greater than in the case of FIG. 8 by the error δ. As a result, the dot pitch between the raster lines recorded in pass 1 (L2, L6) and the raster lines recorded in pass 2 (L1, L5) is short by the amount of δ, the dot pitch between the raster line (L5) recorded in pass 2 and the raster line (L4) recorded in pass 3 is short by the amount of δ, and the dot pitch between the raster line (L4) recorded in pass 3 and the raster line (L3) recorded in pass 4 is short by the amount of δ. As a result of the accumulation of these carry errors, the dot pitch between, for example, the raster line of the second row (L2: the line formed by the sixth nozzle in pass 1) and the raster line of the third row (L3: the line formed by the first nozzle in pass 4) is wide by an amount of 3δ, as shown in FIG. 11A. Thus, as shown in FIG. 11A, the dot pitch is larger than the ideal dot pitch D, resulting in bands of light color that are visible to the unaided eye. These bands of light color (hereinafter, called "bright banding," although they may also be called "white banding" or "light banding.") are observed as a deterioration of picture quality.

Figure 11B:
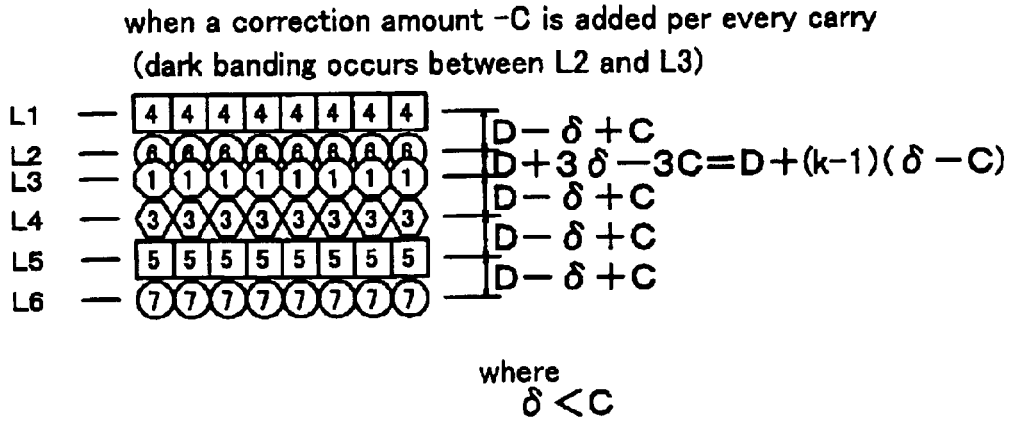
FIG. 11B is an explanatory diagram showing how print bands (banding) occur in FIG. 10 (reference example).

In FIG. 10, a command signal to which a correction amount of −C has been added to the target carry amount F (when the target carry amount F, the carry amount of the carrying unit is F+δ) is input to the carrying unit. Here, C is the minimum carry amount that can be carried by the carrying unit, and it is a value determined from the paper feed motor or the resolution of the rotary encoder, for example. In this embodiment, C is dependant on the resolution of the rotary encoder, and is equal to 1/5760 inch. However, because the carry error δ is smaller than the minimum correction amount C, correcting the transport amount F each time will result in an error δ−C in the direction opposite that of FIG. 9. Consequently, in FIG. 10, the paper S is fed downstream in the paper carrying direction by an amount that is δ−C greater than in the case of FIG. 8 (that is, the paper S is carried in the paper carrying direction by an amount that is insufficient by C−δ). As a result of the accumulation of carry errors, the dot pitch between the raster line of the second row (L2: the line formed by the sixth nozzle in pass 1) and the raster line of the third row (L3: the line formed by the first nozzle in pass 4) is narrow by 3D−3δ (wide by 3δ−3D), as shown in FIG. 11B. For that reason, as shown in FIG. 11A, the dot pitch between L2 and L3 is narrower than the ideal dot pitch D, and thus bands of dark color that can be seen with the naked eye occur. These bands of dark color (hereinafter, called "dark banding," although they may also be called "black banding" or "deep banding") are observed as a deterioration of picture quality.

<Method for Correcting the Carry Amount According to the Present Embodiment>

In the above reference example, it was shown that the picture quality may deteriorate by correcting the carry amount of the carrying unit each time, even if error is included in the carry amount of the carrying unit. Consequently, it is necessary to appropriately set the correction of the carry amount of the carrying unit rather than keep it constant.

Hereinafter, the correction timing and how much to correct the carry amount of the carrying unit are explained in detail.

Method for Correcting the Carry Amount According to the Present Embodiment

<Sequence at which Correction is Performed>

Figure 12:
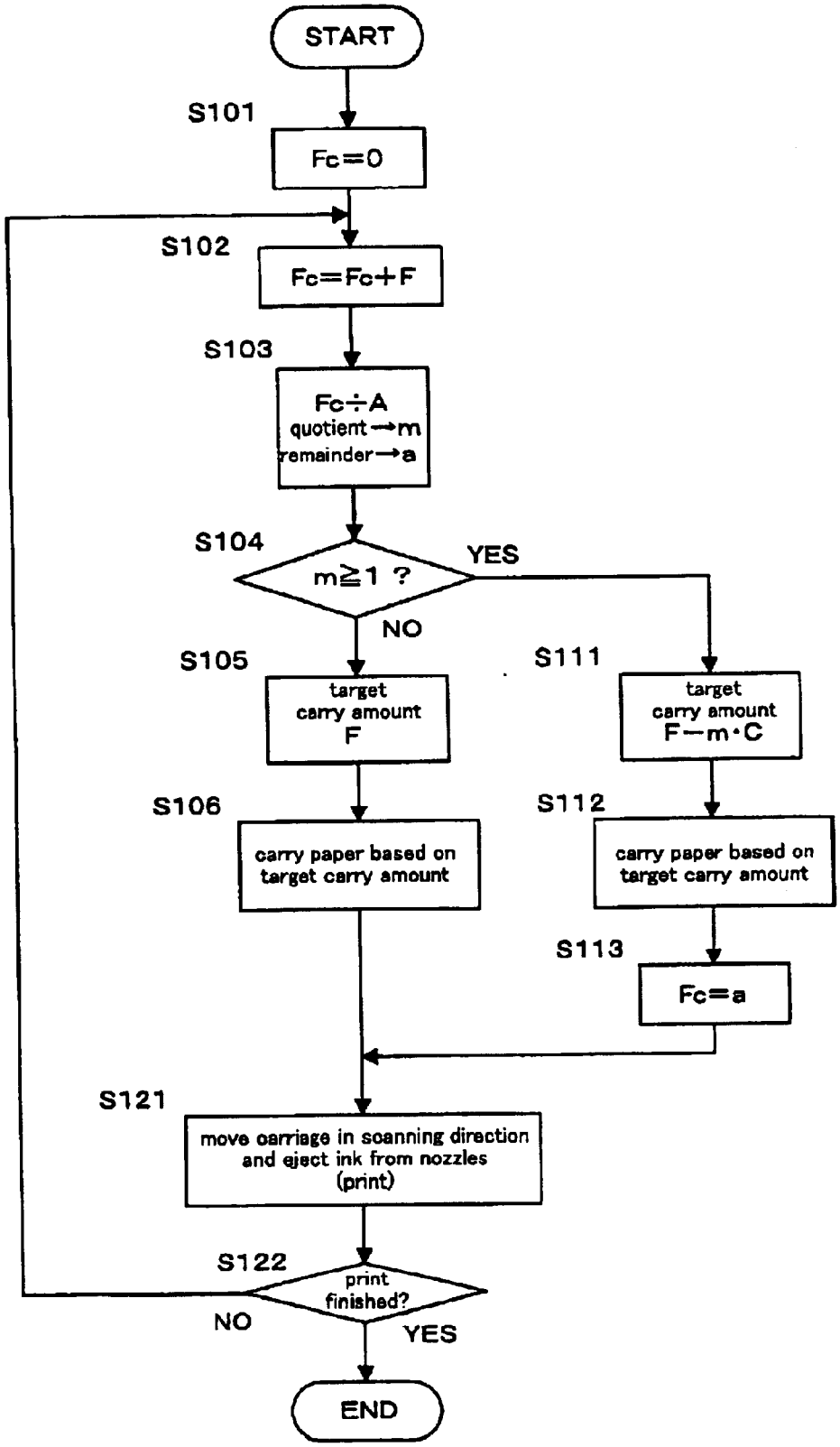
FIG. 12 is a flowchart showing the timing at which the carry amount is corrected in the present embodiment.

FIG. 12 is a flowchart showing the timing at which the carry amount is corrected according to this embodiment. In this embodiment, the amount at which the target carry amount F is corrected when the paper S is carried is determined based on the carry amount at which the carrying unit has already performed a carry prior to the present carry. It should be noted that the operations of the printer described below are controlled by the control unit 60 (or controlled by the printer driver).

First, the state at "START" in the flowchart is of a state in which the front end of the paper S has been detected by the paper width sensor 54 and has been carried from that position to the print start position. The excess carry amount Fc at this time is reset to zero (S101). The characteristics of the excess carry amount Fc are described later.

Next, the carry amount F is added to the excess carry amount Fc (S102). Here, the carry amount F is the ideal single-time carry amount when the paper is carried intermittently. The carry amount F is determined by the print mode, for example, and is either stored in a memory of the main printer unit or is set in advance by the printer driver.

Next, the excess carry amount Fc is divided by the reference correction amount A, and the quotient m and the remainder a are calculated (S103). It should be noted that if the target carry amount is the reference carry amount A, then when the carrying unit carries the paper based on this target carry amount, the paper is carried including the carry error of the minimum correction amount C with respect to the target carry amount A. Conversely, the value for the target carry amount at which the carry error becomes C becomes the reference carry amount A. The method for setting the reference carry amount A is described in detail later.

If the quotient m that is calculated is smaller than 1 (S104), then the target carry amount F is not corrected (S105) and the paper is carried based on the target carry amount F (S106). That is, the correction amount in this case is set to zero.

If the quotient m that is calculated is 1 or more (S104), then the correction amount is set to m·C and the target carry amount F is corrected to F−m·C (S11), and the paper is carried based on the target carry amount F−m·C (S112). In this case, the carry amount F of the paper is corrected, and thus the excess carry amount Fc is set to the remainder a that was calculated in S103 (S113).

Next, printing is performed by moving the carriage in the scanning direction and ejecting ink from the nozzles so as to form dots on the paper (S121). Then, the procedure returns to step S102 if printing is not finished (S122). By repeating this process, the paper is intermittently carried. Printing is carried out by ejecting ink from the moving nozzles and forming dots on the paper between the intermittent carries of the paper. It should be noted that in step S122 the printing can be determined to be finished based on the accumulation of the carry amount of the paper, for example.

As in this embodiment, extreme closeness or distance in the dot pitch D can be prevented even if the correction amount of the carry amount is determined based on the excess carry amount Fc, and thus banding can be kept from occurring. Consequently, if the excess carry amount Fc is stored in a memory, then that value can be used to calculate the correction amount for the target carry amount of the next carry.

Also, according to this embodiment, the target carry amount is not simply corrected each time, but rather the target correction amount is corrected based on the excess carry amount beyond a predetermined position, and thus the target carry amount can be corrected in a manner that reflects the carry status or the correction status before the carry is performed. Furthermore, according to this embodiment, the correction amount is determined by adding the target carry amount to the excess carry amount, and thus the correction amount can be determined in a manner that reflects the carry status or the correction status before and after carrying. Consequently, with this embodiment, it is possible to perform high quality printing.

Also, with the sequence of the method for correcting the carry amount according to this embodiment, the target carry amount F is added to the excess carry amount Fc before the paper is carried, and based on that value, whether or not it is necessary to correct the target carry amount and the correction amount are determined, and thus carry error after an actual carry can be inhibited.

<How Dots are Formed>

Figure 13:
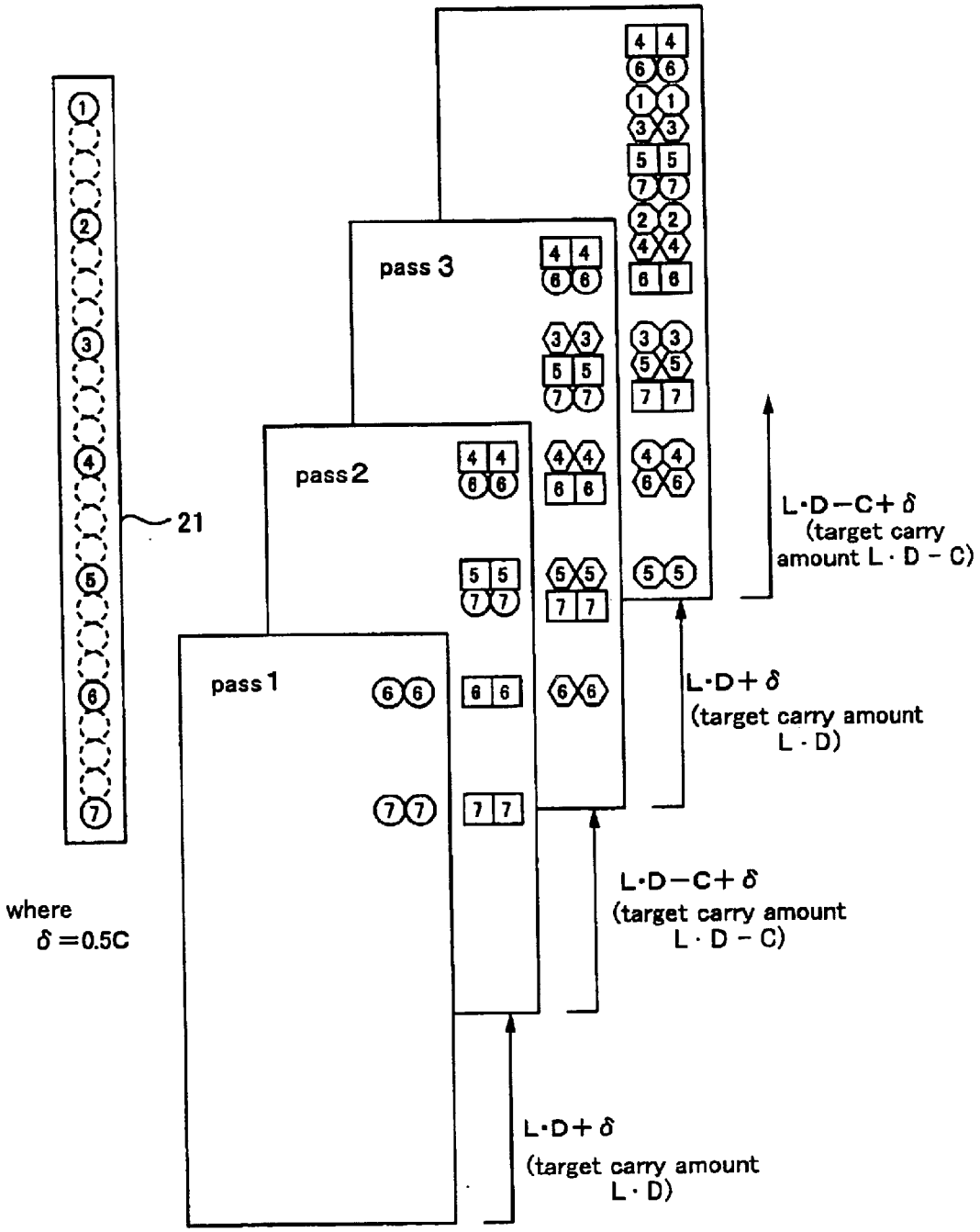
FIG. 13 is an explanatory diagram showing how dots are formed in the present embodiment.
Figures 14, 15:
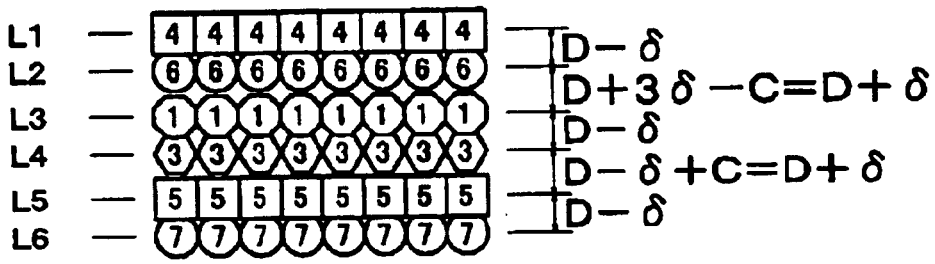
FIG. 14 is an explanatory diagram showing how print bands (banding) are kept from occurring.
FIG. 15 is a table showing the relationship between the carry amount and the correction amount.

FIG. 13 is an explanatory diagram showing how the dots are formed in this embodiment. FIG. 14 is an explanatory diagram showing how the occurrence of printing bands (banding) is inhibited. Here, the target carry amount is set to $F=7\cdot D$ and the reference carry amount is set to $A=14\cdot D$ (it should be noted that the manner in which the reference carry amount A is set is made clear later). When the paper is carried by the target carry amount F, a carry error $\delta$ occurs. Here, the relationship between the carry error $\delta$ and the minimum correction amount C is $\delta=0.5C$. Also, each time the paper is carried by a carry amount of $14\cdot D$, a carry error about the same as the minimum correction amount C occurs (that is, $C=2\cdot\delta$).

This embodiment differs from the reference example mentioned above in that it has both a case where the carry amount of the carrying unit is corrected and also a case where the carry amount of the carrying unit is not corrected (in the diagrams, the carry amount is corrected at a ratio of once per two carries).

In this embodiment as well, the carrying unit carries the paper by the carry amount $(F+\delta)$, which includes a constant positive error $\delta$, when a command signal for a target carry amount F $(=L\cdot D)$ is input. Also, the carry amount between pass 1 and pass 2 and the carry amount between pass 3 and pass 4 are not corrected. As a result, the dot pitch between the raster lines (L2, L6) recorded in pass 1 and the raster lines (L1, L5) recorded in pass 2 is short by $\delta$, and the dot pitch between the raster line (L4) that is recorded in pass 3 and the raster line (L3) that is recorded in pass 4 is short by $\delta$.

On the other hand, the correction amount $-C$ is added to the carry amount between pass 2 and pass 3. As a result, the dot pitch between the raster line (L5) recorded in pass 2 and the raster line (L4) recorded in pass 3 is increased by $C-\delta$ (is shortened by $\delta-C$). Consequently, with this embodiment, as shown in FIG. 14, the dot pitch between the raster line (L2: the line formed by the sixth nozzle in pass 1) of the second row and the raster line (L3: the line formed by the first nozzle in pass 4) of the third row is $D+3\delta-C$ $(=D+\delta)$.

The accumulated carry error in this embodiment is less than in the above-mentioned reference example (FIGS. 11A and 11B), and thus there are no extremes in closeness or distance compared to the ideal dot pitch D, so that banding (dark banding and light banding) can be inhibited.

<Relationship Between the Carry Amount and the Correction Amount>

FIG. 15 is a chart showing the relationship between the carry amount and the correction amount in the case of FIG. 13. Using this chart and the flowchart of FIG. 12, the relationship between the carry amount and the correction amount will be described once again. In FIG. 14 mentioned above, the carry amount is corrected at a ratio of once per two carries; however, in FIG. 15, for the sake of simplifying the description, the carry amount is corrected at a ratio of three times per four carries. That is, a carry error of 3C occurs as the paper is carried by $7D\times4$ (four carries), and thus the reference carry amount A is $A=7D\times4/3$.

(Carry Amount and Correction Amount for Passes 1 and 2)

First, the carry amount and the correction amount from after the raster line of pass 1 is printed up to pass 2 are calculated. The target carry amount F is added to the excess carry amount Fc, which has been reset to zero, and Fc becomes $7\cdot D$ (S102). Then, the excess carry amount $7\cdot D$ is divided by the reference carry amount A $(A=7D\times4/3)$, and the quotient and the remainder are calculated (S103). In this case, the quotient is zero, so that the target carry amount is not corrected and the paper is carried according to the target carry amount F (S104 to S106). Then, the carriage is moved in the scanning direction and ink is ejected from the nozzle, printing the raster line of pass 2.

(Carry Amount and Correction Amount for Passes 2 and 3)

Next, the carry amount and the correction amount up to pass 3 are calculated. Because the carry amount is not corrected in the previous carry, the excess carry amount Fc is $7\cdot D$. The target carry amount F is added to the excess carry amount Fc, and Fc becomes $14\cdot D$ (S102). Next, the excess carry amount $14\cdot D$ is divided by the reference carry amount A $(A=7D\times4/3)$, and the quotient and the remainder are calculated (S103). In this case the quotient is 1, and thus the correction amount is established as $1\cdot C$ and the target carry amount F is corrected to $F-C$. The paper is then carried according to the target carry amount $F-C$. At this time, a remainder of 4.67D is carried over.

(Carry Amount and Correction Amount for Passes 3 and 4)

Next, the carry amount and the correction amount up to pass 4 are calculated. Because the remainder of 4.67D from the previous carry is carried over, the target carry amount F is added to the excess carry amount Fc and Fc becomes 11.67D (S102). Next, the excess carry amount of 11.67D is divided by the reference carry amount A $(A=7D\times4/3)$, and the quotient and the remainder are calculated (S103). In this case the quotient is 1, so that a correction amount is determined to be $1\cdot C$ and the target carry amount F is corrected to $F-C$. The paper is then carried based on this target carry amount $F-C$. At this time, the remainder of 2.33D is carried over.

(Carry Amount and Correction Amount for Passes 4 and 5)

Next, the carry amount and the correction amount up to pass 4 are calculated. Because the remainder of 2.33D from the previous carry is carried over, the target carry amount F is added to the excess carry amount Fc and Fc becomes 9.33D (S102). Next, the excess carry amount of 9.33D is divided by the reference carry amount A $(A=7D\times4/3)$, and the quotient and the remainder are calculated (S103). In this case the quotient is 1, so that a correction amount is determined to be 1·C and the target carry amount F is corrected to F−C. The paper is then carried based on this target carry amount F−C. The remainder at this time is zero.

It should be noted that the carry amount and the correction amount can be found in the same fashion for pass 5 and thereafter. In this embodiment, the carry amount is corrected three times per four carries, and thus there are carries for which correction is carried out and there are carries for which correction is not carried out.

<Relationship Between the Correction Amount and the Carry Error>

Figure 16:
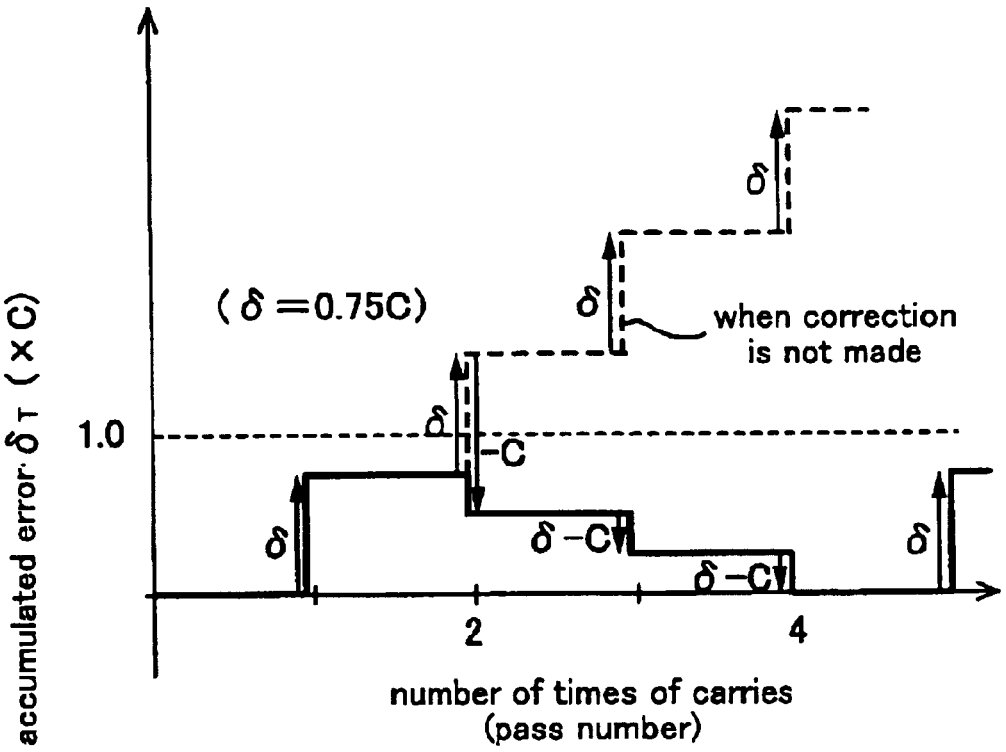
FIG. 16 is a graph showing the relationship between the accumulated error δT and the number of times of carries.

FIG. 16 is a graph showing the relationship between the accumulated error δT and the number of times of carries (passes) in a case where three corrections at the minimum correction amount C are performed for every four carries. In the figure, the solid line shows the accumulated error in a case where the target carry amount is corrected, and the dotted line shows the accumulated error in a case where the target carry amount is not corrected. It should be noted that with the correction method of this embodiment, the correction of the target carry amount is carried out according to the sequence of FIG. 12.

In this embodiment, the carry amount is corrected at a ratio of three times per four carries, and thus it can be surmised that a carry error of δ=0.75C occurs for each carry. If the target carry amount were not corrected, then the carry error that occurs for each carry would accumulate even if it were smaller than the minimum correction amount C, for example (see the dotted line in the figure). The result of the carry error building up would be that banding will occur as illustrated above.

On the other hand, if the target carry amount is corrected at a ratio of three times per four carries, then accumulation of the carry error is corrected (see the solid line in the figure). The result of correcting the accumulation of the carry error is that banding can be kept from occurring.

In particular, if the target carry amount is corrected according to the sequence shown in FIG. 12, then the accumulated error δT can be kept from exceeding the minimum correction amount C. As a result, the dot pitch between raster lines can be brought as close to the ideal dot pitch as allowed by the resolution of the carrying unit (resolution of the encoder), and thus banding can be kept from occurring.

<Timing of the Correction>

Figure 17:
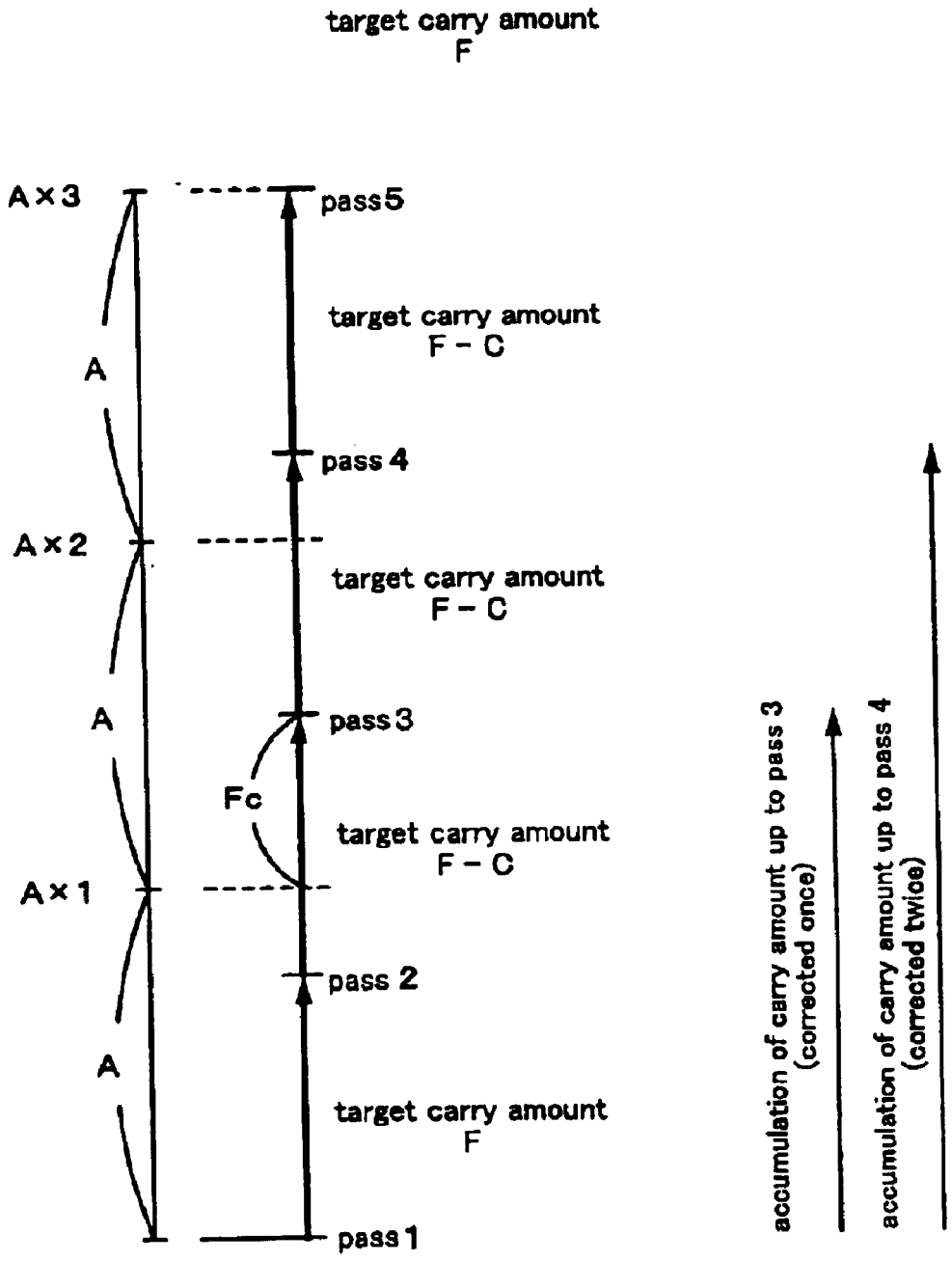
FIG. 17 is an explanatory diagram showing the correction timing and the relationship between the correction amount and the reference carry amount A.

FIG. 17 is an explanatory diagram showing the timing of correction and the relationship between the correction amount and the reference carry amount A when the target carry amount F is corrected according to the sequence of this embodiment. In the figure, the series of arrows indicates that the paper is carried intermittently.

In this embodiment, the reference carry amount A is set so that the target carry amount is corrected at a ratio of three times per four carries. That is, the reference carry amount A is set to F×4/3.

When the reference carry amount A is thus set and the target carry amount is corrected according to the sequence shown in FIG. 12, the target carry amount is corrected each time the paper is carried by a carry amount that is an integer multiple of the reference carry amount. This means that the correction amount is distributed substantially uniformly over the carries as the carrying unit carries the paper intermittently. Also, because the correction of the target carry amount is distributed evenly, the image quality can be improved compared to a case where the correction of the target carry amount is distributed unevenly.

It should be noted that, for example, the above-mentioned excess carry amount Fc (=a) after the paper has been carried up to pass 3 is a carry amount (2×F−A) of the portion that exceeds the reference carry amount A of the carry amounts up to pass 3, as shown in the diagram. Also, this excess carry amount Fc (=a) is added to the target carry amount F for the next carry, and the correction amount for the target carry amount of the next carry is calculated based on this value. In the same fashion, the correction amount of the target carry amount when carrying the paper from pass 4 to pass 5 is calculated based on the value obtained by adding the carry amount (3F−2A) of the portion that exceeds 2×A of the carry amount up to pass 4 and the target carry amount F.

The correction amount with respect to the target carry amount at the time of the carry from pass 3 up to pass 4 can also be found based on the accumulation of the carry amount. That is, by dividing the carry amount accumulated up to pass 4 (the value obtained by adding the target carry amount F to the carry amount up to pass 3) by A, the accumulation of the correction amount at the time of the carry up to pass 4 can be calculated (two portions of the minimum correction amount C in FIG. 17). On the other hand, if the carry amount accumulated up to pass 3 is divided by A, then the correction amount that is accumulated when carrying up to pass 3 can be calculated (one portion of the minimum correction amount C in FIG. 17). The correction amount when carrying from pass 3 to pass 4 can then be determined from the difference between the two accumulated correction amounts. Consequently, if the accumulation of the carry amount is stored in a memory, that value can be used to calculate the correction amount for the target carry amount of the next carry. It should be noted that determining the correction amount based on the accumulation of the carry amount is described later.

Setting the Reference Carry Amount A

As mentioned above, the reference carry amount A is a factor in determining the correction amount for the target carry amount. The reference carry amount A is set based on carry error due to various factors. That is, the reference carry amount A is set so that it can cancel out the various types of carry error. The primary causes of carry error δ are: (1) manufacturing discrepancies of the main printer unit; (2) the type of paper that is fed; and (3) the carry amount of the paper. Accordingly, in this embodiment, the reference carry amount A is set taking into consideration carry error based on these factors.

<Carry Error Due to Manufacturing Discrepancies of the Main Printer Unit>

Carry error δ1 due to manufacturing discrepancies of the main printer unit (differences between individual units) is caused by variation in the diameter of the paper feed roller of the carrying unit, for example. The carry error δ1 is determined by testing the printers in the factory when the printers are shipped from the factory. The carry error δ1 is a value that is unique to each printer.

The carry error δ1 due to manufacturing discrepancies of the main printer unit is determined by printing a test pattern using the printer in the factory before it is shipped, and then evaluating how that test pattern is printed. One possible example of such a test pattern is a pattern in which a plurality of patterns are printed in a stepwise manner at varying correction amounts (carry amounts). The carry error δ1 is then determined by selecting the most appropriate pattern from these plurality of patterns.

The carry error δ1 that has been determined is stored in a memory provided in the main printer unit. The reference carry amount A is set based on the carry error δ1 stored in the memory. It should be noted that in place of the carry error δ1, the information that is stored in the memory can be information about the correction amount (or carry amount) corresponding to the carry error δ1. For example, information on the correction amount with respect to manufacturing discrepancies may also be information to "correct the target carry amount at a ratio of three times per four carries."

<Carry Error Due to the Type of Paper Carried>

A carry error δ2 due to the type of paper that is carried is caused by the paper slipping with respect to the paper feed roller during carrying, for example. Consequently, the carry error δ2 is a smaller value (including cases where it becomes negative) the more likely the paper is to slide, and is a larger value the less likely the paper is to slide. For example, plain paper has a larger carry error value than glossy paper. Also, if the paper that is carried is roll paper, then the paper tends to be pulled toward the roll (that is, in the direction opposite the carrying direction), and thus the carry error δ becomes a small value (including cases where it is a negative value).

The carry error δ2 due to the type of paper is determined as described below. First, the user selects the type of paper to be printed via a user interface for carrying out the settings of the printer driver. A main computer unit in which the printer driver is installed stores a table (reference chart) correlating the type of paper to be printed and the carry error δ2. The table is then referenced based on the type of paper that is selected by the user, and the corresponding carry error δ2 is determined.

The carry error δ2 that is determined is stored in a memory provided in the main computer unit (a device outside the printer). The reference carry amount A is then set based on the carry error δ2 that is stored in the memory. It should be noted that instead of the carry error δ2, the information stored in the memory can be information on the correction amount (or carry amount) corresponding to the carry error δ2. For example, the information about the correction amount for the paper type may be information to "correct the target carry amount in the negative direction at a ratio of twice every four carries."

<Carry Error Due to Carry Amount of Paper>

The carry error δ3 due to the carry amount of the paper occurs due to the paper slipping with respect to the paper feed roller during carrying, for example. Consequently, the carry error δ3 is a large value when the carry amount F is large, and is a small value when the carry amount F is small. It should be noted that the carry amount of the paper is related to the print mode (or the carry mode included in the print mode). For example, a very precise print mode has a smaller carry amount during the intermittent carries than a print mode with low precision. Consequently, with a very precise print mode (or a very precise carry mode), the carry error δ3 is a smaller value than with a low-precision print mode.

The carry error δ3 due to the carry amount of the paper is determined as described below. First, the user selects the print mode through a user interface for carrying out the settings of the printer driver. A main computer unit in which the printer driver is installed stores a table (reference chart) correlating the print mode and the carry error δ3. The table is then referenced based on the print mode selected by the user, and the corresponding carry error δ3 is determined.

The carry error δ3 that has been determined is stored in a memory provided in the main computer unit. The reference carry amount A is then set based on the carry error δ3 that is stored in the memory. It should be noted that instead of the carry error δ3, the information stored in the memory can be information on the correction amount (or carry amount) corresponding to the carry error δ3. For example, the information on the correction amount for the carry amount may be information to "correct the target carry amount at a ratio of twice every four carries."

It should be noted that the carry error δ is not necessarily dependant on the three factors mentioned above. It is also possible for the carry error δ to depend on at least one of the three factors mentioned above.

It should be noted that the carry amount of the paper is determined if the print mode is set, and thus the carry error δ3 can be set based on the print mode. In this way, the target carry amount can be corrected according to the print mode.

<Setting the Reference Carry Amount A>

The reference carry amount A is set based on various types of information on the correction amount (or information on the carry error). The reference carry amount A is set based on the information on the correction amount that is stored in the printer (information on the correction amount for manufacturing discrepancies (first correction information)) and the information on the correction amount that is included in the print data sent from the main computer unit (the information on the correction amount corresponding to the paper type and the correction amount corresponding to the carry amount (second correction information)).

As an example, (1) the information on the correction amount for manufacturing discrepancies may be information to "correct the carry amount at a ratio of three times per four carries," (2) the information on the correction amount corresponding to the paper type may information to "correct the carry amount in the negative direction at a ratio of two times per four carries," and (3) the information on the correction amount corresponding to the carry amount may be information to "correct the carry amount at a ratio of two times per four carries." In this case, taking into consideration all the information about the correction amount, the carry amount is corrected at a ratio of three times (=3 times−2 times+2 times) per four carries. This means that if the target carry amount is 7D, then a carry error of 3C occurs as the paper is carried by 7D×4 (carried four times). Consequently, the reference carry amount A is set to A=7D×4/3.

It should be noted that the target carry amount is corrected according to the reference carry amount A as described above, and this reference carry amount A is set based on various types of information about the correction amount, and thus the target carry amount is corrected based on the various types of information on the correction amount.

Entire Sequence Through End of Printing

Figure 18:
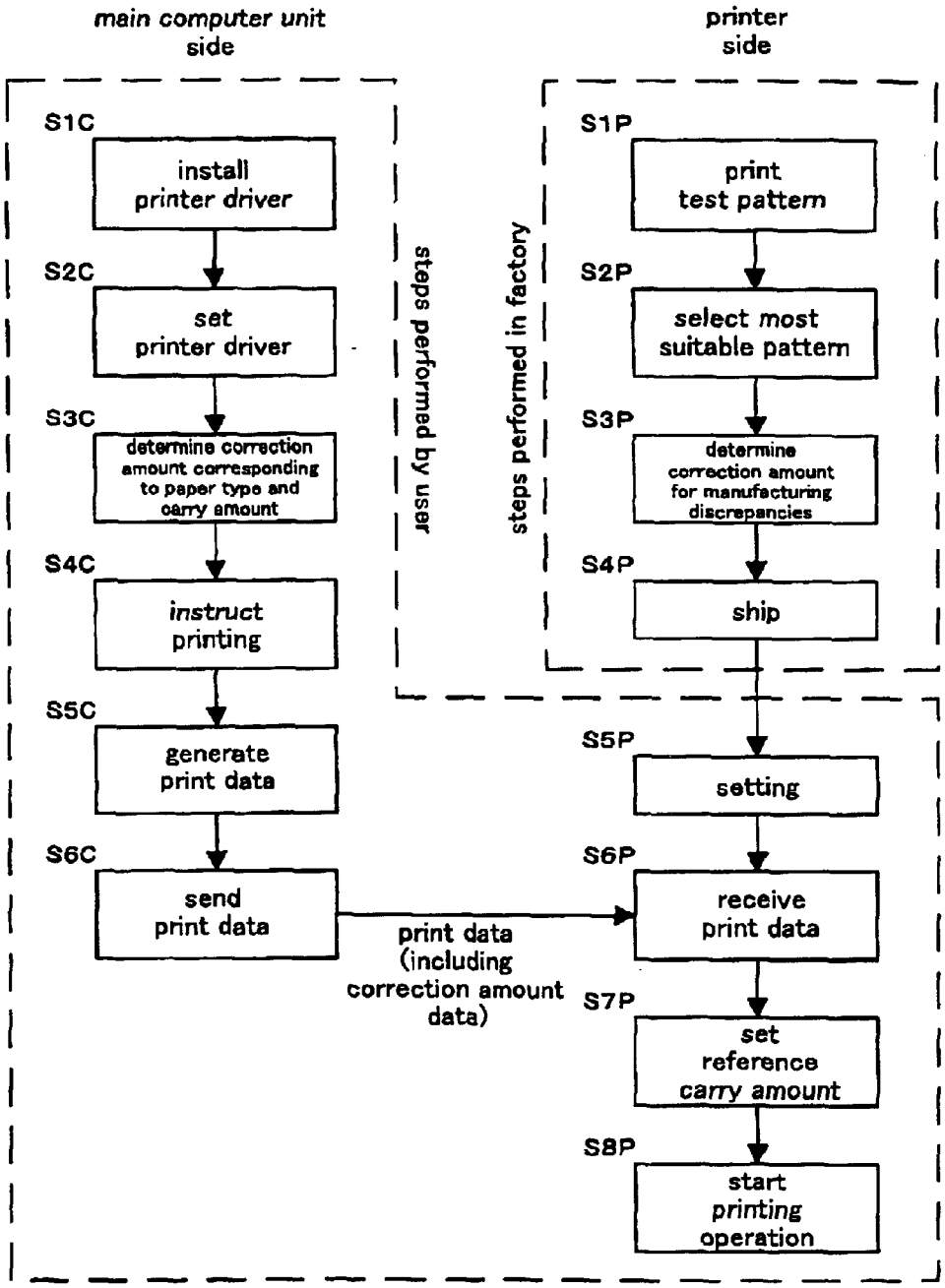
FIG. 18 is a flowchart for describing the overall sequence through the end of printing.

FIG. 18 is a flowchart for describing the operations of the main computer unit and the printer. Hereinafter, this diagram is used to describe the entire sequence through the end of printing and to describe how the reference carry amount A is set. It should be noted that in the figure, S1C to S6C denote steps that are performed by the main computer unit, and S1P to S8P denote steps that are performed by the printer. Also, S1P to S4P are steps that are performed in a factory where the printer is manufactured, and S1C to S6C and S5P to S8P are steps that are performed by the user.

First, a test pattern is printed using the printer that is manufactured in the factory (S1P). The test pattern is made of a plurality of patterns that have been printed in a stepwise fashion with different correction amounts with respect to the target carry amount. That is, the plurality of patterns that are printed as the test pattern each corresponds to a specific correction amount.

Next, a worker or a testing device in the factory checks the test pattern in which the plurality of patterns have been printed, and selects the most suitable pattern among these plurality of patterns (S2P). The pattern is selected using an input device provided in the printer or an input device that is connected to the printer. It should be noted that the most suitable pattern is the printed pattern in which the actual carry amount (the amount actually carried by the corrected target carry amount) is nearest to the target carry amount.

Next, the correction amount for manufacturing discrepancies of the printer is determined (S3P). The correction amount that is determined is the correction amount that is used when the selected pattern is printed. This is because if the target carry amount is corrected using the correction amount with which the most suitable pattern was printed, then the actual carry amount comes close to the target carry amount (the target carry amount before correction). The correction amount for manufacturing discrepancies of the printer is stored in a memory of the printer.

The printer in whose memory is stored the correction amount for manufacturing discrepancies in the factory is packaged and shipped (S4P). The printer that is shipped is delivered to a user. The user that has purchased the printer connects the printer to a main computer unit using a cable and carries out settings (S5P).

After settings are finished, the user installs the printer driver. The printer driver is installed by, for example, making the computer read a CD-ROM, which is a storage medium on which the printer driver program is recorded. However, the printer driver can also be installed, without using a CD-ROM, by downloading the program via a communications line such as the Internet.

Next, the printer driver settings are performed (S2C). The printer driver settings are performed through the user interface of the printer driver. The user interface is displayed on the screen of a display device (described later) connected to the main computer unit. The user then uses the input device (described later) to carry out the various settings of the printer driver.

For example, from this screen, the user can select the type of paper to be printed. When the printer driver is installed, a table (reference chart) correlating the type of paper that is printed and the correction amount is stored in the main computer unit. The table is then referenced in accordance with the type of paper specified by the settings of the printer driver, and the correction amount corresponding to the paper type can be determined (S3C). Also, the user can select the print mode from this screen. The carry amount of the paper is determined if the print mode is set, and thus, in the same fashion, the correction amount corresponding to the carry amount can be determined.

If the user performs a command to print (S4C), print data are created (S5C). The command for printing is carried out by selecting the print command on an application, for example. The source document (image data) created in the application is converted into print data based on the settings of the printer driver.

The print data that is created is transmitted to the printer (S6C). The print data is transmitted after being spooled onto a disk of the main computer unit. However, the print data may be transmitted after being spooled to a print server. The print data that is transmitted includes information on the correction amount corresponding to the paper type and information on the correction amount corresponding to the carry amount. Also, the print data that is transmitted includes information on the target carry amount. It should be noted that the target carry amount that is included in the print data is a value before correction (a value that has not been corrected by the correction amount). The reason for this is described later.

The printer receives the print data from the main computer unit (S6P). The printer can thus obtain information on the target carry amount, information on the correction amount corresponding to the paper type, and information on the correction amount corresponding to the carry amount. The information that is obtained is stored in the memory of the printer.

Next, the reference carry amount A is set based on the various types of information about the correction amount (S7P). The reference carry amount A is set based on the information on the correction amount that is stored in the printer (the information on the correction amount for manufacturing discrepancies) and the information on the correction amount that is included in the print data transmitted from the main computer unit (the information on the correction amount corresponding to the paper type and the correction amount corresponding to the carry amount).

The printing operation is then started in accordance with the sequence illustrated in FIG. 12 mentioned above, based on the reference carry information A that has been set (S8P).

<Reason why Print Data Includes Uncorrected Target Carry Amount>

As mentioned above, the target carry amount that is included in the print data is a value before correction (a value that has not been corrected by the correction amount). The reason for this is described below. It should be noted that in the following description, the information on the correction amount on the computer side is information to "correct the carry amount at a ratio of once per four carries," and the information on the correction amount of the printer side is information to "correct the carry amount at a ratio of twice per four carries."

FIG. 19A is a diagram for describing a comparative example that is different from the present embodiment. FIG. 19B is a diagram for describing the target carry amount that is instructed to the carrying unit in the case of the configuration of this comparative example. In this comparative example, the target carry amount is corrected on the computer side, and the print data that is sent from the computer side to the printer side includes the corrected target carry amount.

With the configuration of this comparative example, a correction amount C is added to the target carry amount (target carry amount that has been corrected) that is included in the print data at a ratio of once per four carries. On the other hand, on the printer side, the target carry amount that is included in the print data is corrected at a ratio of two times per four carries. As a result, for the target carry amount instructed to the carrying unit, the correction amount 2C is added once every four times and the correction amount C is added once every four times, so that correction is carried out twice every four times. That is, with the configuration of this comparative example, the target carry amount (the target carry amount during the intermittent carries) instructed to the carrying unit is not corrected uniformly.

FIG. 20A is a diagram for describing the present embodiment. Also, FIG. 20B is a diagram for describing how correction is carried out in this embodiment. In this embodiment, the target carry amount is not corrected on the computer side, but instead, that value is included in the print data. The target carry amount is then corrected on the printer side based on the correction amounts corresponding to the paper type and the carry amount and the correction amount for the manufacturing discrepancies. As a result, the target carry amount that is instructed to the carrying unit is corrected uniformly in this embodiment.

That is, when the comparative example and the present embodiment are compared, they are alike in that a correction amount of 3C is added every four carries; however, the present embodiment has the advantage in that correction is carried out uniformly. Also, very precise printing can be performed because the printer of this embodiment corrects the target carry amount evenly.

Configuration of the Computer System Etc

Next, embodiments of a computer system, a computer program, and a storage medium storing a computer program are explained with reference to the drawings.

Figure 21:
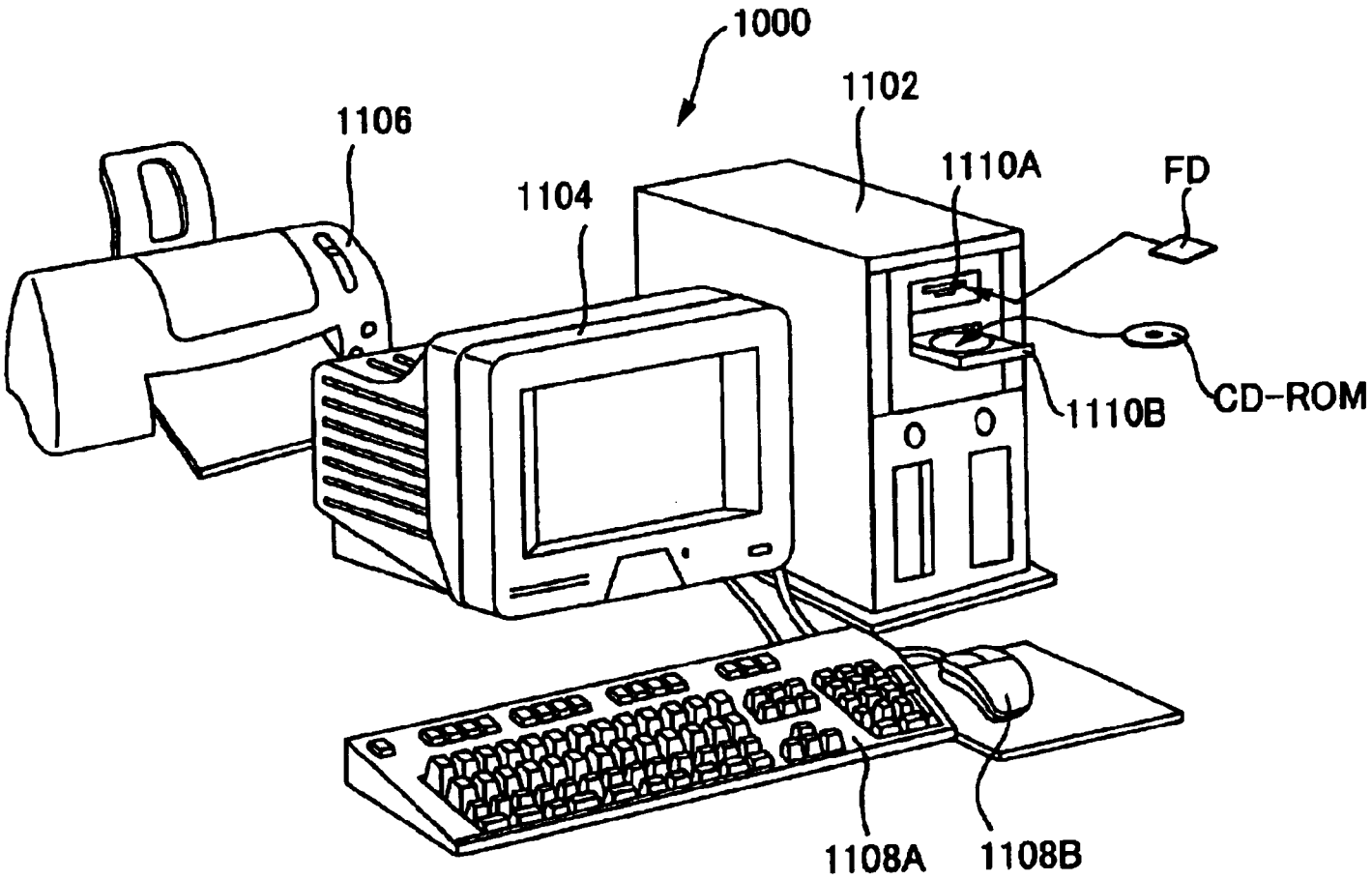
FIG. 21 is an explanatory diagram showing the external configuration of a computer system.

FIG. 21 is an explanatory diagram showing the external structure of the computer system. A computer system 1000 is provided with a main computer unit 1102, a display device 1104, a printer 1106, an input device 1108, and a reading device 1110. In this embodiment, the main computer unit 1102 is accommodated within a mini-tower type housing; however, this is not a limitation. A CRT (cathode ray tube), plasma display, or liquid crystal display device, for example, is generally used as the display device 1104, but this is not a limitation. The printer 1106 is the printer described above. In this embodiment, the input device 1108 is a keyboard 1108A and a mouse 1108B; however, it is not limited to these. In this embodiment, a flexible disk drive device 1110A and a CD-ROM drive device 1110B are used as the reading device 1110, but the reading device 1110 is not limited to these, and it may also be a MO (magnet optical) disk drive device or a DVD (digital versatile disk), for example.

Figure 22:
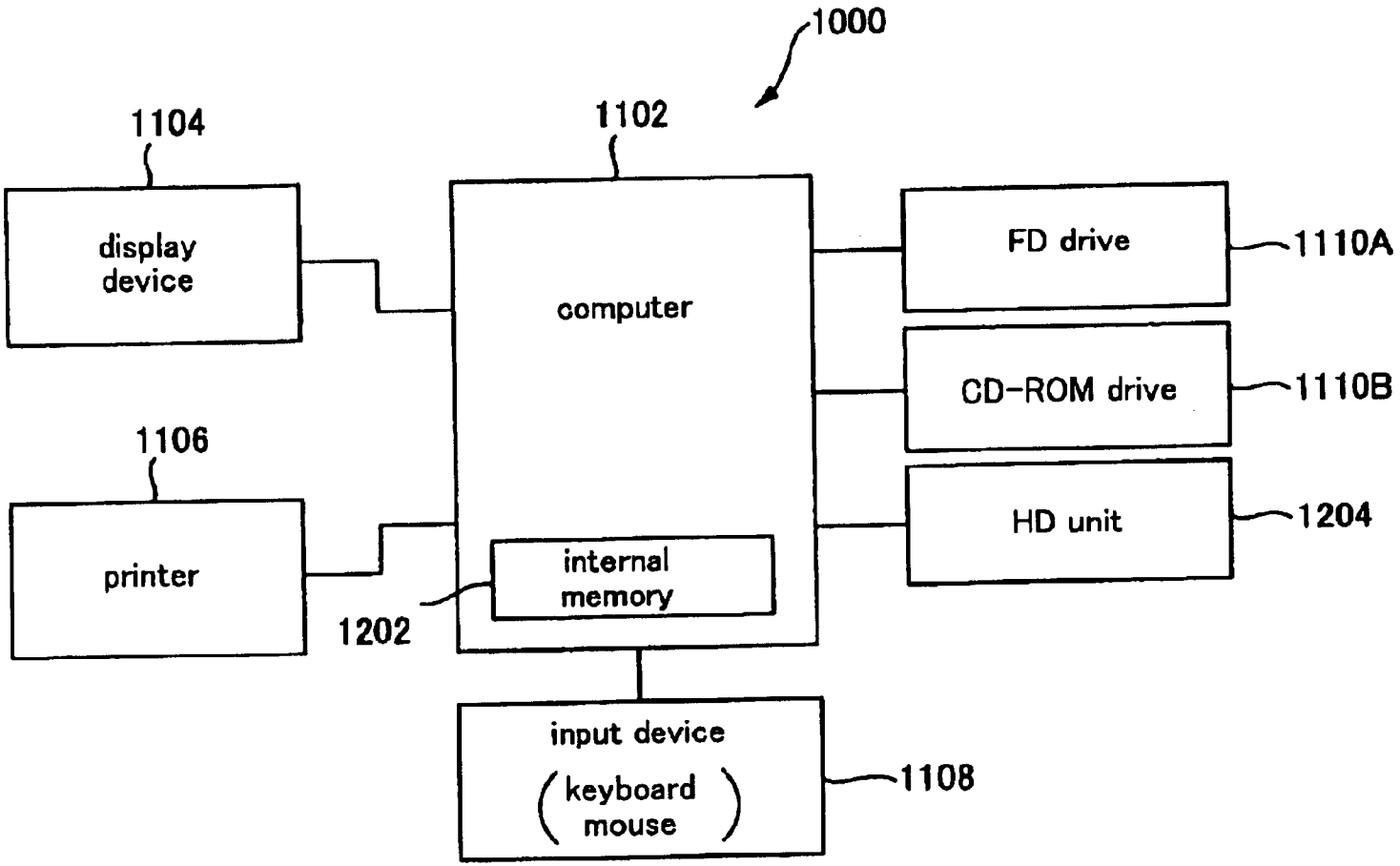
FIG. 22 is a block diagram showing the configuration of the computer system shown in FIG. 21.

FIG. 22 is a block diagram showing the configuration of the computer system shown in FIG. 21. An internal memory 1202 such as a RAM within the housing accommodating the main computer unit 1102 and, also, an external memory such as a hard disk drive unit 1204 are provided. A computer program for controlling the operation of the above printer is stored in a flexible disk FD or a CD-ROM, for example, which is a storage medium, and is read by the reading device 1110. The computer program may also be downloaded onto the computer system 1000 via a communications line such as the Internet.

Figure 23:
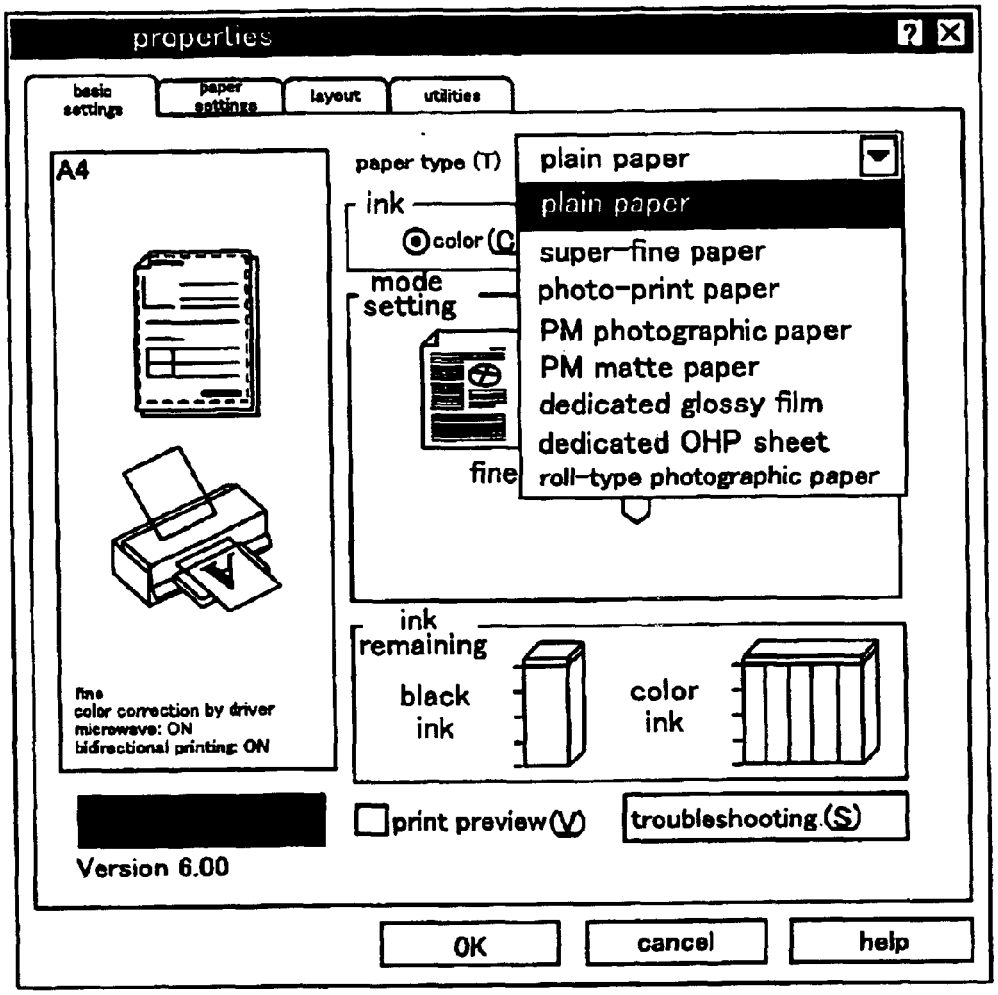
FIG. 23 is an explanatory diagram showing a user interface of a printer driver.

FIG. 23 is an explanatory diagram showing the user interface of the printer driver that is displayed on the screen of the display device 1104 connected to the computer system. The user can use the input device 1108 to carry out the various settings of the printer driver. For example, the user can select the type of paper to be printed from the screen. Also, depending on the type of paper that is selected, the reference carry amount A mentioned above can be set (or the above-mentioned carry error δ can be determined or calculated). The user can also select the print mode from the screen. The carry amount of the paper is determined if the print mode is established, and thus the above-mentioned reference carry amount A can be set. It is also possible to set the reference carry amount A (or the carry error δ) based on other information input by the user to set the printer driver.

Figure 24:
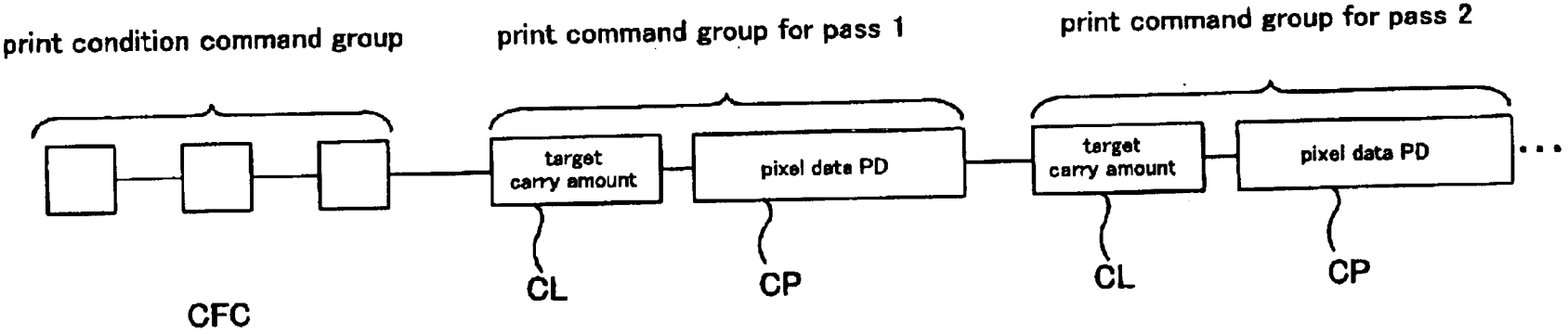
FIG. 24 is an explanatory diagram showing the format of print data that is supplied from the main computer unit to the printer.

FIG. 24 is an explanatory diagram describing the format of the print data that is supplied to the printer 1106 from the main computer unit 1102. The print data is created from the image information in accordance with the settings of the printer driver. The print data has a print condition command group and pass command groups. The print condition command group includes a command for indicating the print resolution and a command for indicating the print direction (single direction/bidirectional), for example. The print command groups for each pass include a target carry amount command CL and a pixel data command CP. The pixel data command CP includes pixel data PD indicating the recording status for each pixel of the dots recorded in that pass. It should be noted that the various commands shown in the diagram each have a header section and a data section; however, here they are shown simplified. Also, these command groups are supplied intermittently to the printer side from the main computer unit side for each command. The print data are not limited to this format, however.

It should be noted that in this embodiment, the information on the correction amount corresponding to the paper type and the information on the correction amount corresponding to the carry amount of the paper are included in the print condition command group. Consequently, different types of paper to be carried lead to different data in the print condition command group. Also, different carry amounts of the paper lead to different data in the print condition command group. Also, in this embodiment, the target carry amount within the pass command groups is not corrected, so that the data of the target carry amount, which serves as a reference when pixel data PD is created, is transmitted to the printer.

In the above description, an example was described in which the computer system is constituted by connecting the printer 1106 to the main computer unit 1102, the display device 1104, the input device 1108, and the reading device 1110; however, this is not a limitation. For example, the computer system can be made of the main computer unit 1102 and the printer 1106, or the computer system does not have to be provided with any one of the display device 1104, the input device 1108, and the reading device 1110. It is also possible for the printer 1106 to have some of the functions or mechanisms of the main computer unit 1102, the display device 1104, the input device 1108, and the reading device 1110. As an example, the printer 1106 may be configured so as to have an image processing section for carrying out image processing, a display section for carrying out various types of displays, and a recording media attachment/detachment section to and from which recording media storing image data captured by a digital camera or the like are inserted and taken out.

In the embodiment described above, it is also possible for the computer program for controlling the printer to be incorporated in the memory 65 of the control unit 60, and for the control unit 60 to execute this computer program so as to achieve the operations of the printer in the embodiment described above.

As a whole system, the computer system that is thus achieved is superior to conventional systems.

Other Embodiments

In the foregoing, a printer, for example, according to the invention was described based on an embodiment thereof. However, the foregoing embodiment is for the purpose of elucidating the present invention and is not to be interpreted as limiting the present invention. The invention can of course be altered and improved without departing from the gist thereof and includes functional equivalents. In particular, the carrying device and the printing apparatus according to the invention include the embodiments mentioned below as well.

<(1) Determining the Correction Amount>

In the embodiment described above, a correction amount for the target carry amount was determined based on information about the carry amount of the paper that exceeded the reference carry amount (the predetermined carry amount). However, the method for determining the correction amount is not limited to that of the embodiment described above, and the correction amount may be determined based on other factors. In other words, the correction amount can be determined based on information on the carry amount that has been carried by the carrying mechanism before a particular carry is performed. Also, if the target carry amount is corrected based on the reference carry amount A set in the above embodiment, then the target carry amount can be corrected based on the correction information stored in the printer and the correction information stored in the computer.

Figure 25:
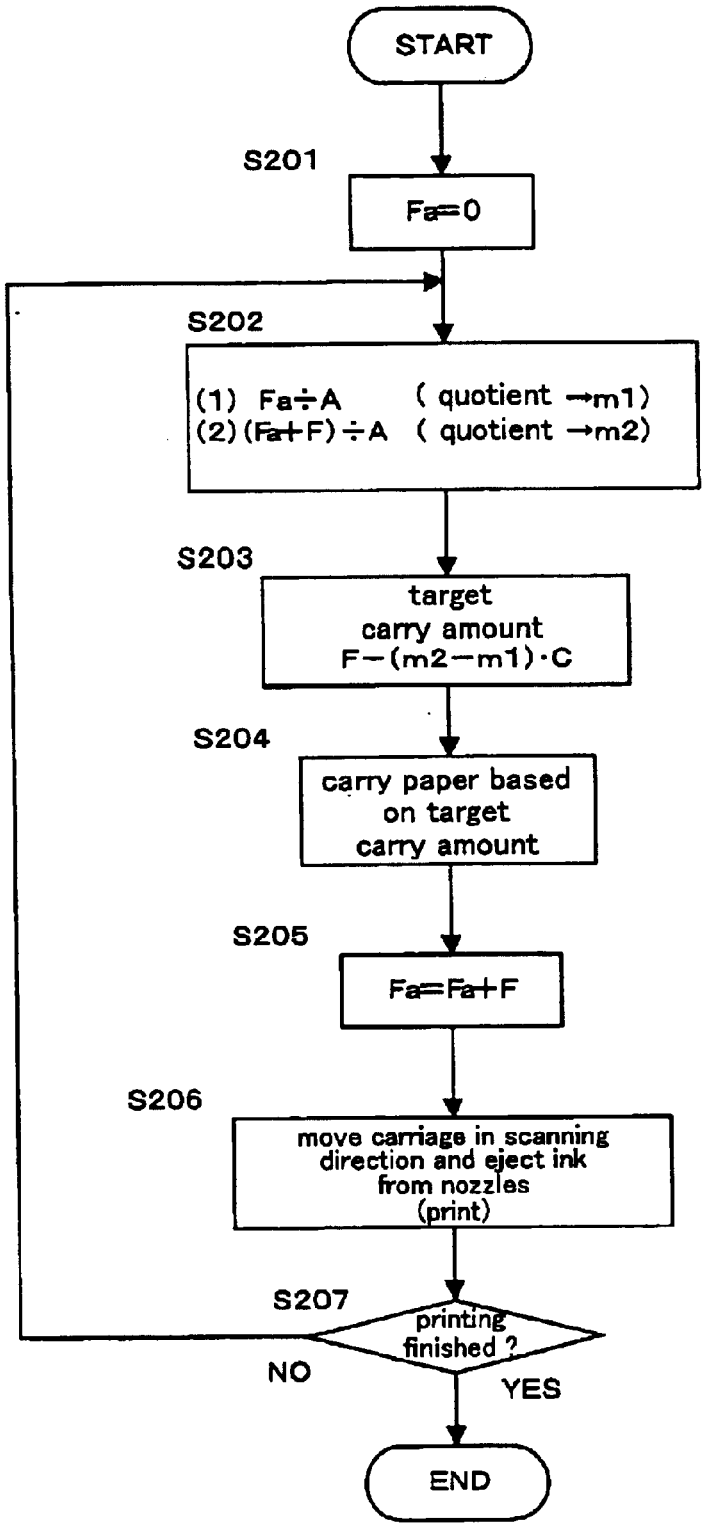
FIG. 25 is a flowchart according to the present embodiment.

FIG. 25 is a flowchart showing the timing at which the carry amount is corrected according to another embodiment. In this embodiment, the amount at which the target carry amount F is corrected when the paper S is carried is determined based on an accumulated carry amount, which is the accumulation of the amount already carried by the carrying unit before a particular carry is performed. It should be noted that the operations of the printer described below are controlled by the control unit 60 (or controlled by the printer driver).

First, the state at "START" in the flowchart is of a state in which the front end of the paper S has been detected by the paper width sensor 54 and carried from that position to the print start position. The accumulated carry amount Fa at this time is reset to zero (S201). The accumulated carry amount Fa, as will become clear from the following description, is the carry amount from the print start position, and it is the accumulation of the amount already carried by the carrying unit.

Next, the accumulated carry amount Fa is divided by the reference carry amount A, and a quotient m1 is calculated. The accumulated carry amount Fa to which the target carry amount F has been accumulated (added) is divided by the reference carry amount A, and a quotient m2 is calculated (S202). Here, the accumulated carry amount Fa to which the target carry amount F has been added becomes the accumulated carry amount after the paper S is carried. It should be noted that the quotient m1 relates to the accumulation of the correction amount before the next carry is performed. Also, the quotient m2 relates to the accumulation of the correction amount after the carry is performed. Consequently, the correction amount can be determined for the next carry based on the value obtained by subtracting quotient m1 from quotient m2. Note that the method for setting the reference carry amount A is the same as that of the embodiment mentioned above.

Next, the correction amount is set to (m2−m1)·C, the target carry amount is corrected to F−(m2−m1)·C (S203), and the paper S is carried based on the corrected target carry amount (S204). That is, the correction amount is determined based on the accumulated carry amount before carrying is performed and the accumulated carry amount after carrying is performed. After the carry, the value of the accumulated carry amount is set to Fa+F (S205).

Next, printing is performed by moving the carriage in the scanning direction and ejecting ink from the nozzles to form dots on the paper (S206). Then, the procedure returns to step S202 if printing is not finished (S207). By repeating this process, the paper is intermittently carried. Also, printing is carried out by ejecting ink from moving nozzles and forming dots on the paper between the intermittent carries of the paper. It should be noted that in step S207, it is possible to determined that printing is finished based on the accumulated carry amount Fa, for example.

With this embodiment, the same effects as in the embodiment described above can be obtained.

<(2) Determining the Correction Amount>

In the embodiment described above, a correction amount for the target carry amount was determined based on the reference carry amount A (information on the carry amount). However, the method for determining the correction amount is not limited to that of the embodiment described above, and the correction amount may be determined based on other factors. In other words, the correction amount can be determined based on information on the carry performed by the carrying unit before a particular carry is performed. Also, the target carry amount can be corrected on the printer side based on the correction information stored in the printer and the correction information stored in the computer.

Figure 26:
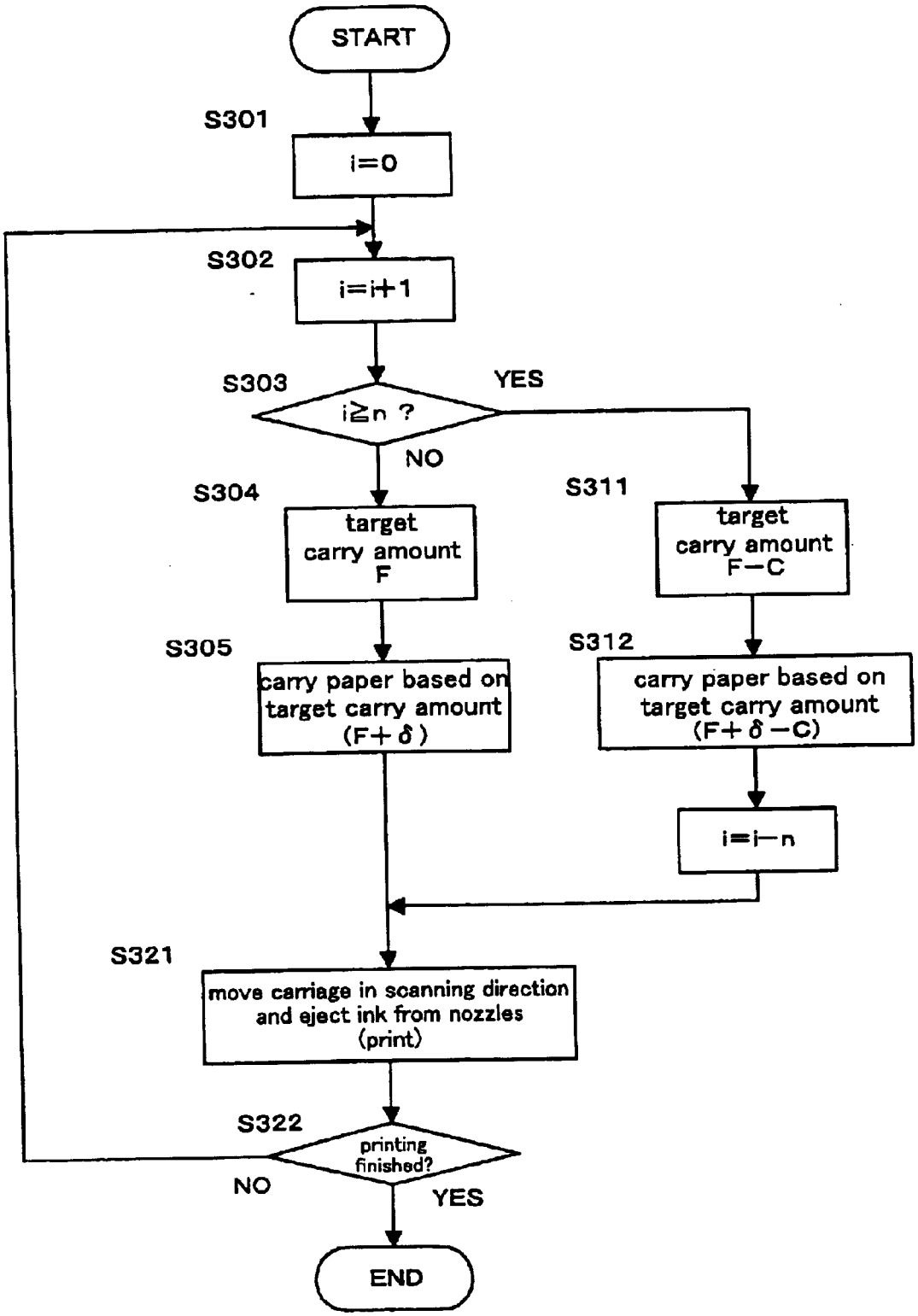
FIG. 26 is a flowchart according to another embodiment.

FIG. 26 is a flowchart showing the timing at which the carry amount is corrected according to another embodiment. In this embodiment, the number of times of intermittent carries is the factor for determining the correction amount. More specifically, the carry amount is corrected once every n carries. It should be noted that the operations of the printer described below are controlled by the control unit 60 (or controlled by the printer driver).

First, the state at "START" in the flowchart is of a state in which the front end of the paper S has been detected by the paper width sensor 54 and carried from that position to the print start position. The count i at this time is zero (S301).

Next, 1 is added to the count i (S302). This means that a carry of one carry amount will be performed.

Next, the correction operation is performed once every n times of carries, and thus whether the count i is larger than n is determined (S303). It should be noted that when n times of carries are performed, it can be assumed that a carry error of the minimum correction amount C occurs with respect to the target carry amount.

If the count i is smaller than n, then the target carry amount F is not corrected (S304) and the paper is carried based on the target carry amount F (S305). It should be noted that in this case, the actual carry amount of the paper includes an error δ with respect to the target carry amount F.

If the count i is larger than n, then the target carry amount F is corrected to F−C (S311) and the paper is carried based on the target carry amount F−C (S312). Also, in this case, since the paper carry amount F of the paper is corrected, n is subtracted from the count i (S313). It should be noted that here the actual carry amount of the paper includes an error δ with respect to the target carry amount F−C.

Next, printing is performed by moving the carriage in the scanning direction and ejecting ink from the nozzles to form dots on the paper (S321). Then, the procedure returns to step S302 if printing is not finished (S322). By repeating this process, the paper is carried intermittently. Printing is carried out by forming dots on the paper between the intermittent carries of the paper. It should be noted that in step S322 it is possible to determine whether printing is over based on the total carry amount of the paper.

In this embodiment, extreme closeness or distance in the dot pitch D can be prevented even if the determination of whether it is necessary to correct the carry amount is based on the number of times of carries when carrying intermittently, and thus banding can be kept from occurring.

It should be noted that it is not necessary that n in the above explanation is an integer. For example, if n is 4/3, then in the same manner as in the embodiment illustrated in FIG. 15 mentioned above, the carry amount can be corrected every three out of four carries.

It is also possible to determine in advance at which carry number of the n number of times of carries the correction is to be performed. However, the value of n is set on the printer side based on correction information stored in the printer side and correction information stored in the computer side. Accordingly, the correction amount can be determined based on information on the carries that have already been performed by the carrying unit, even if the above-mentioned target carry amount A is not determined. Additionally, the carry precision can be improved even if the carry error is not determined. As in the preceding embodiment, the carry precision can be improved in this embodiment as well.

<(1) Correction Information>

According to the embodiment described above, the information on the correction amount for the paper type is stored on the computer side and is determined by setting the printer driver. However, information on the correction amount for the paper type may also be stored on the printer side and may also be determined by detecting the paper type on the printer side. In this case, a paper type sensor for detecting the paper type is required on the printer side. However, it is possible to detect the paper type using the paper width sensor 54 provided on the carriage. It should be noted that if the information on the correction amount for the paper type is stored in the printer, then it is not necessary to include that information in the print data.

<(2) Correction Information>

According to the embodiment described above, the correction information stored in the printer side was information on the correction amount for manufacturing discrepancies of the printer. However, the type of correction information is not limited to this. That is, it is only necessary for the correction information to be information for correcting the target carry amount.

Similarly, the information stored in the computer side was information on the correction amount corresponding to the paper type and information on the correction amount corresponding to the carry amount. However, the types of correction information are not limited to these. That is, it is only necessary for the correction information to be information for correcting the target carry amount.

<Correction Amount>

With the embodiment described above, the correction amount of the target carry amount was either one unit of the minimum correction amount C or zero. However, the correction amount is not limited to this.

Figure 28:
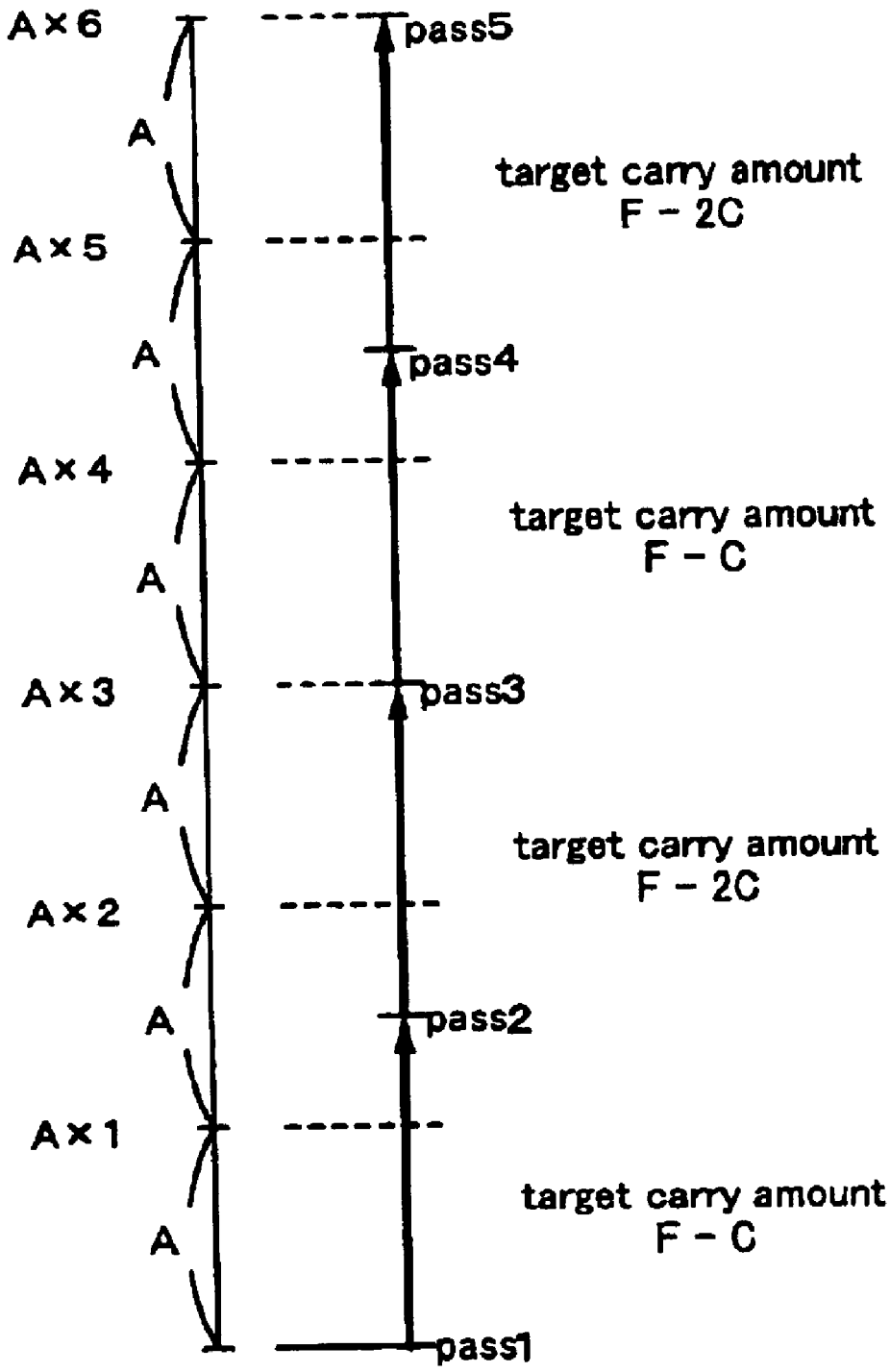
FIG. 28 is a table showing the relationship between the carry amount and the correction amount in the case of FIG. 27.

FIG. 27 is an explanatory diagram, showing the correction timing and the relationship between the correction amount and the reference correction amount A, like FIG. 17, in a case where six units of the minimum correction amount C are corrected by every four carries. Also, FIG. 28 is a chart showing the relationship between the carry amount and the correction amount in this case. It should be noted that in the embodiment mentioned above, there were seven nozzles and the target carry amount F was seven; however, in this embodiment, the number of nozzles is 180 and the target carry amount is 179·D.

In this embodiment, the correction amount of the target carry amount is six portions of the minimum correction amount C per four carries. Consequently, the reference carry amount A is set to F×4/6.

When the reference carry amount A is thus set and the target carry amount is corrected in accordance with the sequence of the previously described embodiment, the target carry amount is corrected each time that the paper is carried by a carry amount that is an integer multiple of the reference carry amount. This means that, when the carrying unit intermittently carries the paper, it distributes the correction amount substantially evenly over the carries. Also, because the correction of the target carry amount is distributed evenly, the image quality is improved over a case where the correction of the target carry amount is distributed unevenly.

<Printing Method>

In the embodiment mentioned above, description was made for a case in which the carry amount correction is for an interlacing-type printing method; however, the printing method is not limited to this.

Also, in the embodiment mentioned above, a single raster line is formed by dots resulting from ink droplets ejected from a single nozzle. This is not a limitation, however. For example, a single raster line can also be formed using two or more nozzles (so-called "overlapping printing").

Other printing methods may of course also adopt the method of correcting the carry amount according the embodiment described above.

<Carry Amount>

In the embodiment described above, the carry amount when the paper is carried intermittently was a constant carry amount F. However, the carry amount of the paper is not limited to this. For example, the carry amount can differ depending on the print mode. The carry amount may also differ for the upper end and the lower end of the paper. The settings for the main printer unit or the printer driver, for example, can be carried out so that the conditions for correcting the carry amount are different when the carry amount is different.

<Method for Ejecting Ink>

In the embodiment described above, ink droplets were ejected using piezo elements. However, the method for ejecting ink is not limited to this. For example, ink droplets can be ejected from the nozzles by generating bubbles using heaters, for example, or ink droplets can be ejected through other methods.

<Nozzles>

In the embodiment described above, the nozzles were provided in the head 21 and the head 21 was provided on the carriage 41, and thus the nozzles were provided integrally with the carriage 41. However, the configuration of the nozzles and the head 21 is not limited to this. For example, the nozzles or the head may be provided integrally with the cartridge 48 (see FIG. 2) and be attachable and detachable to and from the carriage 41.

<Timing at which Correction is Performed>

Figure 29:
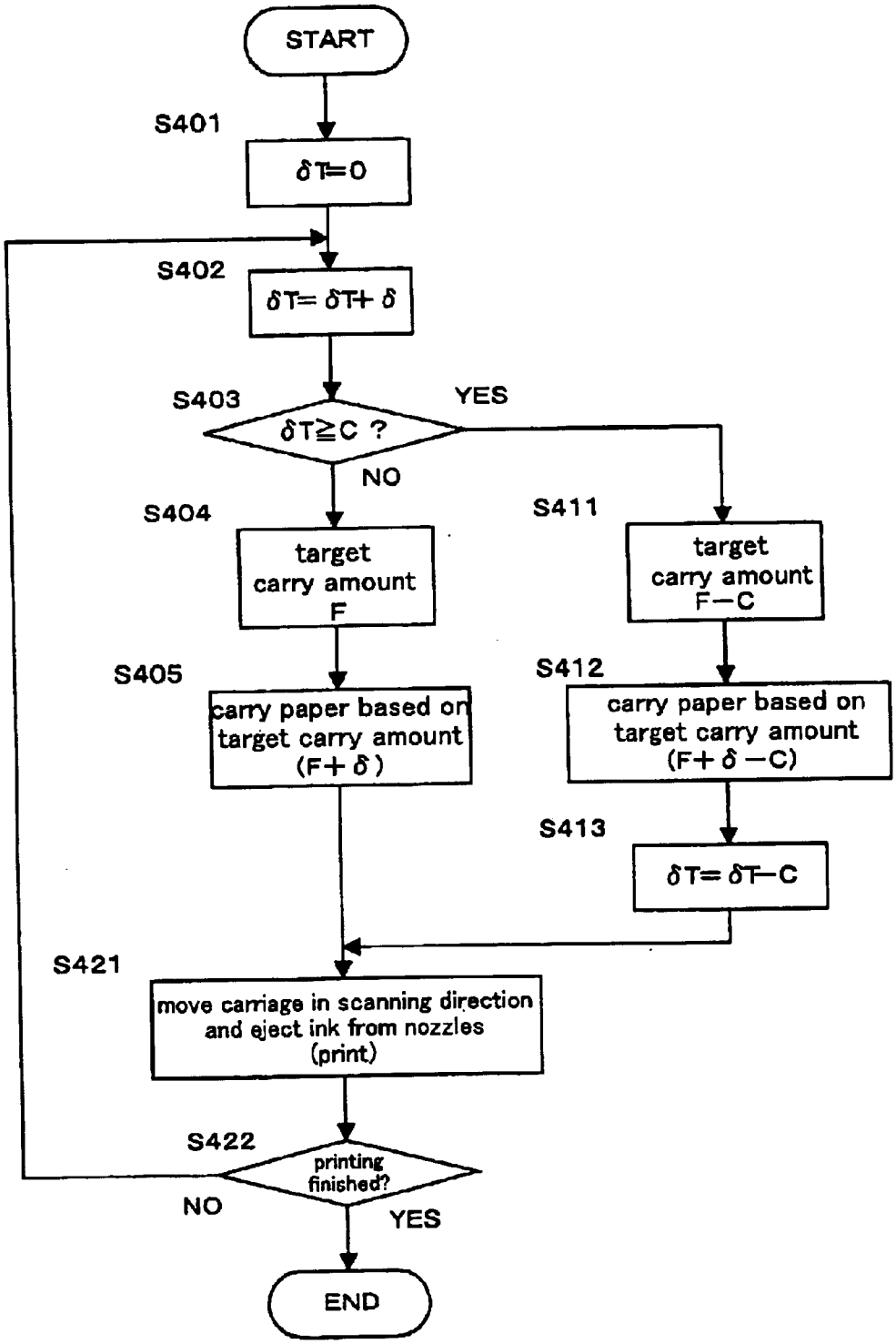
FIG. 29 is a flowchart showing the timing at which the carry amount is corrected in the present embodiment.

FIG. 29 is a flowchart showing the timing at which the carry amount is corrected in this embodiment. Hereinafter, the timing at which the carry amount is corrected is described using this figure. It should be noted that the operations of the printer described below are controlled by the control unit 60 (or by the printer driver).

First, the state at "START" in the flowchart is of a state in which the front end of the paper S has been detected by the paper width sensor 54 and carried from that position to the print start position. The accumulated carry error (hereinafter, accumulated error δT) at this time is zero (S401).

Next, the carry error δ is added to the accumulated error δT (S402). Here, the carry error δ is the error that is included in the actual carry amount when the paper is carried based on the target carry amount F. Also, the carry error δ is either stored in the memory of the main printer unit or is set beforehand by the printer driver.

Next, it is determined whether the accumulated error δT is larger than the minimum correction amount C for the carry amount of the printer (S403). It should be noted that the carry error δ is added to the accumulated error δT before this is determined (that is, before the actual carry is performed) (S402), and thus the accumulated error δT that is to be the object of determination here is not the accumulated error before the paper is carried, but rather, the accumulated error that is expected after the paper has been carried.

If the accumulated error δT is smaller than the minimum carry amount C, then the target carry amount F is not corrected (S404) and the paper is carried based on the target carry amount F. It should be noted that in this case, the actual carry amount of the paper includes the error δ with respect to the target carry amount F (S405).

If the accumulated error δT is larger than the minimum carry amount C, then the target carry amount F is corrected to F−C (S411) and the paper is carried based on the target carry amount F−C. It should be noted that, in this case, the actual carry amount of the paper includes the error δ with respect to the target carry amount F−C (S412). Also, in this case, since the accumulated error δT of the paper is corrected, the minimum correction amount C is subtracted from the accumulated error δT (S413).

Next, printing is performed by moving the carriage in the scanning direction and ejecting ink from the nozzles to form dots on the paper (S421). Then, the procedure returns to step S402 if printing is not finished (S422). By repeating this process, the paper is carried intermittently. Printing is carried out by forming dots on the paper between the intermittent carries of the paper. It should be noted that in step S422 the accumulated target carry amount of the paper can be used to determine whether printing is finished.

In the sequence of the method for correcting the carry amount according to this embodiment, the carry amount is corrected when the accumulated error δT that is expected after the paper has been carried is greater than the minimum carry amount C, and thus the actual accumulated error will not exceed the minimum correction amount. As a result, extreme closeness or distance in the dot pitch D can be prohibited, and thus banding can be kept from occurring.

Figure 30:
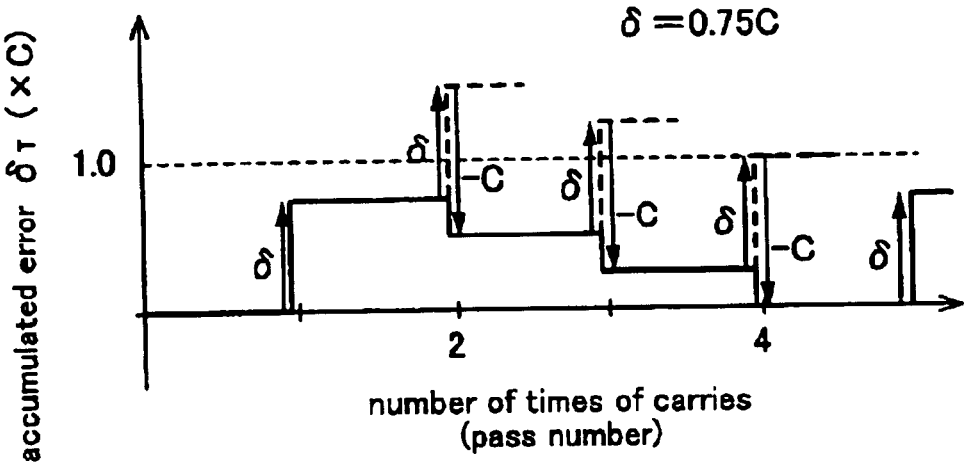
FIG. 30 is a graph showing the relationship between the accumulated error δT and the number of times of carries (δ=0.75C).

FIG. 30 is a graph showing the relationship between the accumulated error δT and the number of times of carries in an example of this embodiment in which δ=0.75C. Hereinafter, the timing at which the carry amount is corrected in this case is described using this figure and FIG. 29.

In the first carry (pass 1) of the paper, the accumulated error δT in S402 is 0.75C, and thus δT is determined to be less than C (S403). Therefore, the target carry amount is F (S404). That is, in this case, the carry amount is not corrected in pass 1. Then, actual carrying of the paper is performed at the carry amount F+δ (S405) and printing is carried out (S421). It should be noted that, in the graph, the accumulated error δT is 0.75C before 1 on the horizontal axis because in S402, the accumulated error that is expected before the paper is carried is taken into account (the same applies hereinafter).

Next, in the second carry (pass 2) of the paper, the accumulated error δT in S402 is 1.50C and thus δT is determined to be equal to or greater than C (S403). Therefore, the target carry amount is F−C (S411). That is, in this case, the carry amount is corrected in pass 2. Then, actual carrying of the paper is performed at the carry amount F+δ−C (S412) and printing is carried out (S421). It should be noted that the accumulated error δT at this time is δT=0.5C because the carry amount is corrected.

Then, in the third carry (pass 3) of the paper, the accumulated error δT in S402 is 1.25C and thus δT is determined to be equal to or greater than C (S403). Therefore, the target carry amount becomes F−C (S411). That is, in this case, the carry amount is corrected in pass 3. Then, actual carrying of the paper is performed at the carry amount F+δ−C (S412) and printing is carried out (S421). It should be noted that the accumulated error δT at this time is δT=0.25C because the carry amount is corrected.

Next, in the fourth carry (pass 4) of the paper, the accumulated error δT in S402 is 1.0C and thus δT is determined to be equal to or greater than C (S403). Therefore, the target carry amount becomes F−C (S411). That is, in this case, the carry amount is corrected in pass 4. Then, actual carrying of the paper is performed at the carry amount F+δ−C (S412) and printing is carried out (S421). It should be noted that the accumulated error δT at this time is δT=0 because the carry amount is corrected.

The operations of the subsequent passes are substantially the same as the operations from pass 1 to pass 4. That is, the carry amount is corrected in three out of four carries.

<(1) Determining Whether or Not it is Necessary to Correct the Carry Amount>

In the embodiment described earlier, the post-carry accumulated error δT is found in advance before the paper is carried, and whether it is necessary or not to correct the carry amount is determined from the relationship between that accumulated error δT and the minimum correction amount C. However, determination of whether or not it is necessary to correct the carry amount is not limited to this.

Figure 31:
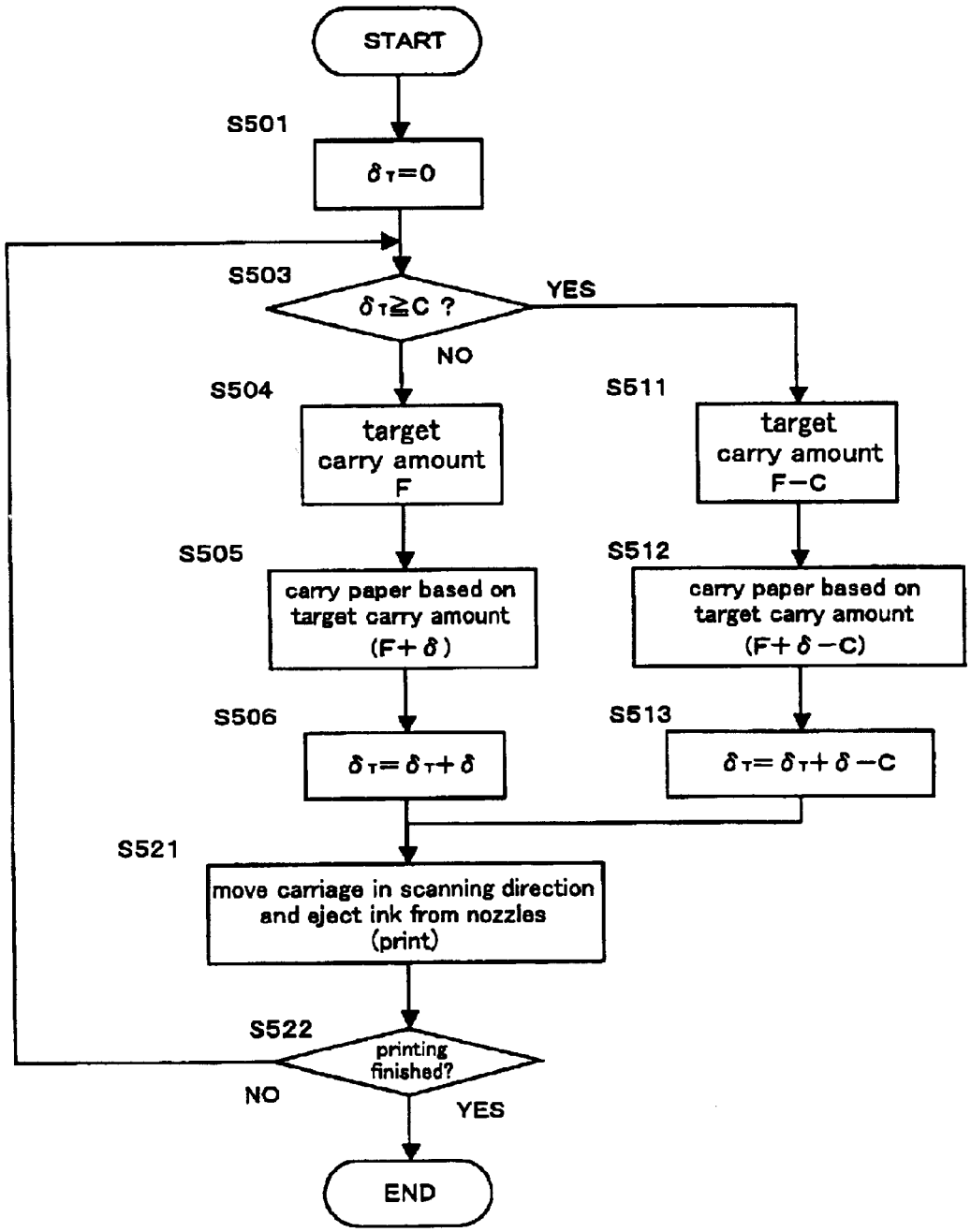
FIG. 31 is a flowchart showing the timing at which the carry amount is corrected according to another embodiment.

For example, FIG. 31 is a flowchart showing the timing at which the carry amount is corrected according to another embodiment. The operations of the printer described below are controlled by the control unit 60 (or controlled by the printer driver).

First, the state at "START" in the flowchart is of a state in which the front end of the paper S has been detected by the paper width sensor 54 and carried from that position to the print start position. The accumulated carry error (hereinafter, referred to as the accumulated error δT) is zero at this time (S501).

Next, it is determined whether the accumulated error δT is larger than the minimum correction amount C of the carry amount of the printer (S503). In the embodiment described above, the accumulated error δT that is assessed is the value found before an actual carry is performed, whereas in this embodiment the current accumulated error δT of the carry amount is taken as the object of determination.

If the accumulated error δT is smaller than the minimum carry amount C, then the target carry amount F is not corrected (S504) and the paper is carried according to the target carry amount F. It should be noted that, in this case, the actual carry amount of the paper includes an error δ with respect to the target carry amount F (S505). Then, after the paper has been carried, δ is added to the accumulated error δT in order to record the current accumulated error δT (S506).

If the accumulated error δT is larger than the minimum carry amount C, then the target carry amount F is corrected to F−C (S511) and the paper is carried according to the target carry amount F−C. It should be noted that, in this case, the actual carry amount of the paper includes the error δ with respect to the target carry amount F−C (S512). Next, after the paper has been carried, δ is added to the accumulated error δT in order to record the current accumulated error δT, and, since the accumulated error δT of the paper is corrected, the minimum correction amount C is subtracted from the accumulated error δT (S513).

Next, printing is performed by moving the carriage in the scanning direction and ejecting ink from the nozzles to form dots on the paper (S521). Then, the procedure returns to step S503 if printing is not finished (S522). By repeating this process, the paper is carried intermittently. Also, printing is carried out by forming dots on the paper between the intermittent carries of the paper. It should be noted that in step S522, printing can be determined to be finished based on the accumulation of the target carry amount of the paper.

In the sequence of the method for correcting the carry amount according to this embodiment, the carry amount is corrected when the current accumulated error δT is greater than the minimum correction amount C. In case as well, extreme closeness or distance in the dot pitch D can be inhibited, and thus banding can be kept from occurring.

<(2) Determining Whether or Not it is Necessary to Correct the Carry Amount>

The factor for determining whether or not it is necessary to correct the carry amount is not limited to whether the accumulated error is larger or smaller than the minimum correction amount, as in the embodiment described above, and other determining factors may also be used.

Figure 32:
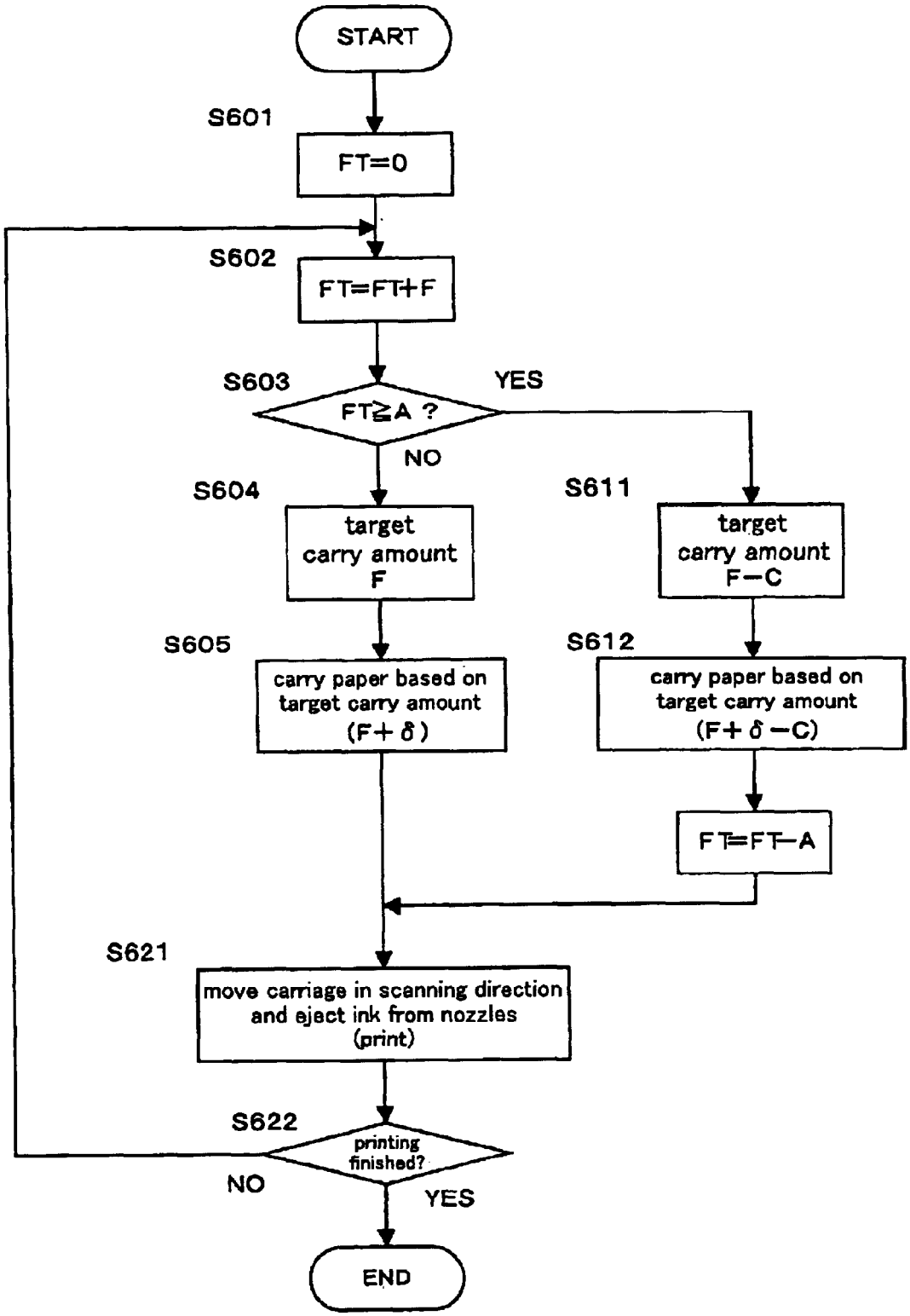
FIG. 32 is a flowchart showing the timing at which the carry amount is corrected according to another embodiment.

FIG. 32 is a flowchart showing the timing at which the carry amount is corrected according to another embodiment. In this embodiment, the total carry amount of the paper serves as the factor for determining whether or not correction is necessary. The operations of the printer described below are controlled by the control unit 60 (or controlled by the printer driver).

First, the state at "START" in the flowchart is of a state in which the front end of the paper S has been detected by the paper width sensor 54 and carried from that position to the print start position. The carried-over carry error FT is zero at this time (S601).

Next, the carry amount F is added to the carried-over carry amount FT (S602). Here, the carry amount F is the carry amount by which the paper is intermittently carried one time. Also, the carry amount F is determined according to the print mode, for example, and is either stored in the memory of the main printer unit or is set in advance by the printer driver.

Next, it is determined whether the carried-over carry amount FT is larger than the reference carry amount A (S603). It should be noted that a carry error of the minimum correction amount C occurs with respect to the target carry amount when the paper is carried by the reference carry amount A.

If the carried-over carry amount FT is smaller than the reference carry amount A, then the target carry amount F is not corrected (S604) and the paper is carried according to the target carry amount F. It should be noted that, in this case, the actual carry amount of the paper includes an error δ with respect to the target carry amount F (S605).

If the carried-over carry amount FT is larger than the reference carry amount A, then the target carry amount F is corrected to F−C (S611) and the paper is carried according to the target carry amount F−C. It should be noted that, in this case, the actual carry amount of the paper includes the error δ with respect to the target carry amount F−C (S612). Also, in this case, since the carry amount F of the paper is corrected, the reference carry amount A is subtracted from the carried-over carry amount FT (S613).

Next, printing is performed by moving the carriage in the scanning direction and ejecting ink from the nozzles to form dots on the paper (S621). Then, the procedure returns to step S602 if printing is not finished (S622). By repeating this process, the paper is carried intermittently. Also, printing is carried out by forming dots on the paper between the intermittent carries of the paper. It should be noted that in step S622 the printing can be determined to be finished based on the total carry amount of the paper.

In this embodiment, extreme closeness or distance in the dot pitch D can be prevented even when the necessity of correcting the carry amount is determined based on the total carry amount of the paper, and thus banding can be kept from occurring.

What is claimed is:

1. A carrying device comprising:

a carrying mechanism for carrying a medium according to a target carry amount;

wherein said carrying device:

stores first correction information for correcting said target carry amount according to said target carry amount;

receives information on said target carry amount from an outside section;

corrects said target carry amount based on said first correction information and second correction information that is stored in said outside section and that is for correcting said target carry amount according to said target carry amount; and carries said medium with said carrying mechanism based on a corrected target carry amount.

2. A carrying device according to claim 1 wherein said first correction information is information on a carry error that occurs due to a discrepancy unique to the carrying device.

3. A carrying device according to claim 1 wherein:

said carrying mechanism intermittently carries said medium; and said first correction information is information on a ratio of correction to a number of times of carries performed by said carrying mechanism.

4. A carrying device according to claim 1 wherein said second correction information is information corresponding to a type of said medium.

5. A carrying device according to claim 4 wherein said second correction information is information corresponding to the ease with which said medium will slip.

6. A carrying device according to claim 1 wherein said second correction information is information corresponding to a carry mode of said carrying mechanism.

7. A carrying device according to claim 6 wherein said second correction information is information for correcting said target carry amount the more the larger said target carry amount is.

8. A carrying device according to claim 1 wherein:

said carrying mechanism is for carrying said medium intermittently; and said second correction information is information on a ratio of correction to a number of times of carries performed by said carrying mechanism.

9. A carrying device according to claim 1 wherein:

said carrying mechanism is for carrying said medium intermittently; and when said carrying mechanism intermittently carries said medium, there are instances in which said carrying device corrects said target carry amount and instances in which it does not correct said target carry amount.

10. A carrying device according to claim 1 wherein said carrying device:

sets a reference carry amount that serves as a reference based on said first correction information and said second correction information; and performs correction of said target carry amount each time said carrying mechanism carries said medium in excess of said reference carry amount.

11. A carrying device according to claim 1, further comprising:

a detector for detecting a carry amount of said medium that said carrying mechanism carries; wherein said carrying device corrects said target carry amount using as a minimum unit of correction a carry amount that is detectable by said detector.

12. A printing apparatus comprising:

a carrying mechanism for carrying a medium according to a target carry amount;

wherein said printing apparatus:

stores first correction information for correcting said target carry amount according to said target carry amount;

receives information on said target carry amount from an outside section;

corrects said target carry amount based on said first correction information and second correction information that is stored in said outside section and that is for correcting said target carry amount according to said target carry amount; and carries said medium with said carrying mechanism based on a corrected target carry amount.

13. A carrying method for carrying a medium, comprising:

storing first correction information for correcting a target carry amount according to said target carry amount;

receiving information on said target carry amount from an outside section;

correcting said target carry amount based on said first correction information and second correction information that is stored in said outside section and that is for correcting said target carry amount according to said target carry amount; and carrying said medium based on a corrected target carry amount.

14. A carrying device comprising:

a carrying mechanism for intermittently carrying a medium according to a target carry amount;

wherein said carrying device:

determines a correction amount for said target carry amount for when performing an intermittent carry based on information on a carry amount at which carrying has been performed by said carrying mechanism before performing that carry.

15. A carrying device according to claim 14 wherein said information on said carry amount includes information on an accumulated carry amount that is obtained by accumulating the carry amount for which said medium has been carried by said carrying mechanism.

16. A carrying device according to claim 15 wherein said correction amount is determined based on said accumulated carry amount before performing a carry and a carry amount in which said target carry amount has been added to said accumulated carry amount.

17. A carrying device according to claim 15 wherein said correction amount is determined in accordance with a quotient when said accumulated carry amount is divided by a reference carry amount serving as a reference.

18. A carrying device according to claim 17 wherein said reference carry amount is set based on information on said medium.

19. A carrying device according to claim 17 wherein said reference carry amount is set based on a ratio of correction to a carry amount at which carrying is performed by said carrying mechanism.

20. A carrying device according to claim 17 wherein said reference carry amount is set based on a print mode.

21. A carrying device according to claim 14 wherein said information on said carry amount includes information on an excess carry amount at which carrying in excess of a predetermined carry amount has been performed by said carrying mechanism.

22. A carrying device according to claim 21 wherein said correction amount is determined based on a value obtained by adding said excess carry amount to said target carry amount.

23. A carrying device according to claim 21 wherein said predetermined carry amount is an integer multiple of a reference carry amount serving as a reference.

24. A carrying device according to claim 23 wherein correction of said target carry amount is performed each time a carry at said reference carry amount is performed.

25. A carrying device according to claim 23 wherein said reference carry amount is set based on information on said medium.

26. A carrying device according to claim 23 wherein said reference carry amount is set based on a ratio of correction to a carry amount at which carrying is performed by said carrying mechanism.

27. A carrying device according to claim 23 wherein said reference carry amount is set based on a print mode.

28. A carrying device according to claim 14, further comprising:

a detector for detecting a carry amount of said medium that said carrying mechanism carries; wherein said correction amount is an integer multiple of a minimum carry amount that is detectable by said detector.

29. A carrying method for intermittently carrying a medium, comprising:

when a carry of said medium is to be performed, obtaining information on a carry amount at which carrying has been performed before performing that carry;

determining a correction amount based on said information on said carry amount that has been obtained;

correcting a target carry amount based on said correction amount that has been determined; and carrying said medium according to said target carry amount that has been corrected.

30. A printing apparatus comprising:

a carrying mechanism for carrying a medium according to a target carry amount, and a carriage for moving a plurality of nozzles arranged at a nozzle pitch k·D;

wherein said printing apparatus performs:

when forming, on said medium, dots at a dot pitch D in a carrying direction by alternately repeating carrying of said medium in said carrying direction using said carrying mechanism and ejection of ink from said nozzles that are moved, carrying of said medium according to a target carry amount that has been corrected and carrying of said medium according to a target carry amount that has not been corrected, when performing k times of carries.

31. A printing apparatus according to claim 30 wherein a raster line formed after a certain carry operation is adjacent to a raster line formed (k−1) times of carry operations after forming that raster line.

32. A printing apparatus according to claim 30 wherein whether or not correction of said target carry amount is necessary is determined based on an error of a carry amount of a medium that said carrying mechanism carries.

33. A printing apparatus according to claim 30 wherein whether or not correction of said carry amount is necessary is determined based on an error of a carry amount that has accumulated due to said intermittent carrying.

34. A printing apparatus according to claim 33 wherein said carry amount is corrected when said error that has accumulated is larger than a carry amount that can be corrected by said carrying mechanism.

35. A printing apparatus according to claim 32 wherein said error of said carry amount is found before an error actually occurs.

36. A printing apparatus according to claim 30 wherein whether or not correction of said target carry amount is necessary is determined based on a carry amount of said medium.

37. A printing apparatus according to claim 30 wherein whether or not correction of said target carry amount is necessary is determined based on a total carry amount of said intermittent carrying.

38. A printing apparatus according to claim 30 wherein whether or not correction of said target carry amount is necessary is determined based on a number of times of said intermittent carrying.

39. A printing method comprising:

forming dots on a medium at a dot pitch D in a carrying direction by repeating in alternation a step of carrying said medium according to a target carry amount, and a step of moving a plurality of nozzles arranged at a nozzle pitch k·D and ejecting ink from said nozzles that are moved; and performing, when k times of carries are performed, carrying of said medium according to a target carry amount that has been corrected and carrying of said medium according to a target carry amount that has not been corrected.

* * * * *